US006588569B1

(12) United States Patent
Jenrick et al.

(10) Patent No.: US 6,588,569 B1
(45) Date of Patent: Jul. 8, 2003

(54) CURRENCY HANDLING SYSTEM HAVING MULTIPLE OUTPUT RECEPTACLES

(75) Inventors: Charles P. Jenrick, Chicago, IL (US); Robert J. Klein, Chicago, IL (US); Curtis W. Hallowell, Palatine, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 276 days.

(21) Appl. No.: 09/688,526

(22) Filed: Oct. 16, 2000

Related U.S. Application Data

(63) Continuation-in-part of application No. 09/502,666, filed on Feb. 11, 2000.

(51) Int. Cl.[7] ..... G07C 3/00; G07F 7/04
(52) U.S. Cl. ..... 194/206; 194/200; 194/207; 271/158; 209/534
(58) Field of Search ..... 194/200, 206, 194/207; 271/149, 156, 157, 158, 180, 181, 31.1; 209/534; 221/242

(56) References Cited

U.S. PATENT DOCUMENTS 3,245,534 A 4/1966 Smith et al. ..... 382/7
3,246,295 A 4/1966 DeClaris et al. ..... 382/56

(List continued on next page.)

FOREIGN PATENT DOCUMENTS

DE 2659929 5/1976
DE 2935668 A1 9/1979

(List continued on next page.)

OTHER PUBLICATIONS

Glory UW–200 Multipurpose Compact Currency Sorter, 4 pp., ©1999.
Glory UW–100 Compact Currency Fitness Sorter, 2 pp., ©1999.
Glory GFRT–1 Currency Scanner, 12/94.

(List continued on next page.)

*Primary Examiner*—Christopher P. Ellis
*Assistant Examiner*—Thuy V. Tran
(74) *Attorney, Agent, or Firm*—Jenkens & Gilchrist

(57) ABSTRACT

A method and apparatus for handling bill jams within a currency processing device is provided. The device includes a transport mechanism adapted to transport bills along a transport path, one at a time, from the input receptacle past an evaluation unit into a plurality of output receptacles. At least one of the output receptacles includes a holding area and a storage area. A plurality of bill passage sensors are sequentially disposed along the transport path that are adapted to detect the passage of a bill as each bill is transported past each sensor. An encoder is adapted to produce an encoder count for each incremental movement of the transport mechanism. A controller counts the total number of bills transported into each of the holding areas and the total number of bills moved from a holding area to a corresponding storage area after a predetermined number of bills have been transported into the holding area. The controller tracks the movement of each of the bills along the transport path into each of the holding areas with the plurality of bill passage sensors. The presence of a bill jam is detected when a bill is not transported past one of the plurality of bill passage sensors within a requisite number of encoder counts. The operation of the transport mechanism is suspended upon detection of a bill jam. The bills from each of the holding areas are moved to the corresponding storage areas upon suspension of the operation of the transport mechanism. Remaining bills are then flushed from the transport path after moving the bills from each of the holding areas to the corresponding storage areas upon suspension of the operation of the transport mechanism.

31 Claims, 24 Drawing Sheets

U.S. PATENT DOCUMENTS

| | | | | |
|---|---|---|---|---|
| 3,280,974 | A | 10/1966 | Riddle et al. | 209/111.8 |
| 3,443,107 | A | 5/1969 | Modglin | 250/219 |
| 3,480,785 | A | 11/1969 | Aufderheide | 250/219 |
| 3,496,370 | A | 2/1970 | Haville et al. | 250/219 |
| 3,509,535 | A | 4/1970 | Berube | 340/149 |
| 3,612,835 | A | 10/1971 | Andrews et al. | 235/61.11 D |
| 3,618,765 | A | 11/1971 | Cooper et al. | 209/534 |
| 3,679,314 | A | 7/1972 | Mustert | 356/71 |
| 3,764,899 | A | 10/1973 | Peterson et al. | 324/61 R |
| 3,778,628 | A | 12/1973 | Novak et al. | 250/556 |
| 3,815,021 | A | 6/1974 | Kerr | 324/61 R |
| 3,842,281 | A | 10/1974 | Goodrich | 250/461 |
| 3,870,629 | A | 3/1975 | Carter et al. | 209/111.8 |
| 3,906,449 | A | 9/1975 | Marchak | 340/146.3 R |
| 3,976,198 | A | 8/1976 | Carnes, Jr. et al. | 209/111.7 T |
| 4,041,456 | A | 8/1977 | Ott et al. | 340/146.3 R |
| 4,081,131 | A | 3/1978 | Sand et al. | 235/419 |
| 4,096,991 | A | 6/1978 | Iquchi | 235/419 |
| 4,114,804 | A | 9/1978 | Jones et al. | 235/476 |
| 4,147,430 | A | 4/1979 | Gorgone et al. | 356/51 |
| 4,164,770 | A | 8/1979 | Jeffers | 360/113 |
| 4,167,458 | A | 9/1979 | Louzos et al. | 204/14 |
| 4,179,685 | A | 12/1979 | O'Maley | 340/146.3 |
| 4,236,639 | A | * 12/1980 | Boettge et al. | 209/534 |
| 4,250,806 | A | 2/1981 | Boyson et al. | 101/2 |
| 4,255,651 | A | 3/1981 | Phillips | 235/92 |
| 4,275,874 | A | 6/1981 | DiBlasio | 271/4 |
| 4,277,774 | A | 7/1981 | Fuji et al. | 340/146.3 |
| 4,283,708 | A | 8/1981 | Lee | 340/146.32 |
| 4,288,781 | A | 9/1981 | Sellner et al. | 340/146.3 |
| 4,302,781 | A | 11/1981 | Ikeda et al. | 358/486 |
| 4,311,914 | A | 1/1982 | Huber | 250/556 |
| 4,313,598 | A | 2/1982 | DiBlasio | 271/124 |
| 4,332,348 | A | 6/1982 | Nordin | 232/43.3 |
| 4,334,619 | A | 6/1982 | Horino et al. | 209/551 |
| 4,348,656 | A | 9/1982 | Gorgone et al. | 340/146.3 R |
| 4,349,111 | A | 9/1982 | Shah et al. | 209/534 |
| 4,352,988 | A | 10/1982 | Ishida | 250/559 |
| 4,355,300 | A | 10/1982 | Weber | 340/146.3 C |
| 4,356,473 | A | 10/1982 | Freudenthal | 340/146.3 H |
| 4,357,528 | A | 11/1982 | Smith et al. | 235/92 |
| 4,365,700 | A | 12/1982 | Arimato et al. | 194/2 |
| 4,376,364 | A | 3/1983 | Horino et al. | 53/54 |
| 4,381,447 | A | 4/1983 | Horvath et al. | 250/223 |
| 4,386,432 | A | 5/1983 | Nakamura et al. | 382/7 |
| 4,388,662 | A | 6/1983 | Jeffers et al. | 360/113 |
| 4,398,088 | A | 8/1983 | Hirose et al. | 235/379 |
| 4,413,296 | A | 11/1983 | Jeffers | 360/113 |
| 4,442,541 | A | 4/1984 | Finkel et al. | 382/7 |
| 4,458,816 | A | 7/1984 | Horino et al. | 209/548 |
| 4,461,028 | A | 7/1984 | Okubo | 382/15 |
| 4,464,786 | A | 8/1984 | Nishito et al. | 382/7 |
| 4,464,787 | A | 8/1984 | Fish et al. | 382/7 |
| 4,470,496 | A | 9/1984 | Steiner | 914/4 C |
| 4,470,590 | A | 9/1984 | Ariga et al. | 271/187 |
| RE31,692 | E | 10/1984 | Tyburski et al. | 382/7 |
| 4,479,049 | A | 10/1984 | Hirose | 235/279 |
| 4,480,177 | A | 10/1984 | Allen | 235/379 |
| 4,482,058 | A | 11/1984 | Steiner | 209/534 |
| 4,487,306 | A | 12/1984 | Nao et al. | 382/135 |
| 4,490,846 | A | 12/1984 | Ishida et al. | 382/7 |
| 4,501,418 | A | 2/1985 | Ariga et al. | 271/187 |
| 4,503,963 | A | 3/1985 | Steiner | |
| 4,513,439 | A | 4/1985 | Gorgone et al. | 382/7 |
| 4,532,641 | A | 7/1985 | Nishimura | 377/14 |
| 4,539,702 | A | 9/1985 | Oka | 382/7 |
| 4,542,829 | A | 9/1985 | Emery et al. | 209/534 |
| 4,547,896 | A | 10/1985 | Ohtombe et al. | 382/318 |
| 4,553,846 | A | 11/1985 | Hilton et al. | 356/429 |
| 4,556,140 | A | 12/1985 | Okada | 194/4 |
| 4,557,597 | A | 12/1985 | Iwama | 356/71 |
| 4,558,224 | A | 12/1985 | Gober | 250/460.1 |
| 4,559,451 | A | 12/1985 | Curl | 250/560 |
| 4,559,452 | A | 12/1985 | Igaki et al. | 250/560 |
| 4,563,771 | A | 1/1986 | Gorgone et al. | 382/7 |
| 4,567,370 | A | 1/1986 | Falls | 250/461.1 |
| 4,585,928 | A | 4/1986 | Watanabe | 235/379 |
| 4,587,412 | A | 5/1986 | Apisdorf | 235/449 |
| 4,587,434 | A | 5/1986 | Roes et al. | 250/556 |
| 4,592,090 | A | 5/1986 | Curl et al. | 382/7 |
| 4,593,184 | A | 6/1986 | Bryce et al. | 235/449 |
| 4,611,345 | A | 9/1986 | Ohniski et al. | 382/7 |
| 4,625,870 | A | 12/1986 | Nao et al. | 209/534 |
| 4,628,194 | A | 12/1986 | Dobbins et al. | 235/379 |
| 4,629,382 | A | 12/1986 | Ueshin | 414/48 |
| 4,638,988 | A | 1/1987 | Kershaw | |
| 4,645,936 | A | 2/1987 | Gorgone | 250/556 |
| 4,653,647 | A | 3/1987 | Hashimoto | 209/534 |
| 4,658,289 | A | 4/1987 | Nagano et al. | 358/75 |
| 4,677,682 | A | 6/1987 | Miyaqawa et al. | 382/7 |
| 4,681,229 | A | 7/1987 | Uesaka et al. | 209/534 |
| 4,683,508 | A | 7/1987 | Jeffers et al. | 360/113 |
| 4,690,268 | A | 9/1987 | Ueshin | 198/399 |
| 4,694,963 | A | 9/1987 | Takesako | 209/534 |
| 4,697,071 | A | 9/1987 | Hiraoka et al. | 235/379 |
| 4,700,368 | A | 10/1987 | Munn et al. | 377/8 |
| 4,707,843 | A | 11/1987 | McDonald et al. | 377/8 |
| 4,716,456 | A | 12/1987 | Hosaka | 358/75 |
| 4,733,308 | A | 3/1988 | Nakamura et al. | 358/496 |
| 4,747,492 | A | 5/1988 | Saito et al. | 209/534 |
| 4,749,087 | A | 6/1988 | Buttifant | 382/7 |
| 4,764,976 | A | 8/1988 | Kallin et al. | 382/65 |
| 4,784,274 | A | 11/1988 | Mori et al. | |
| 4,804,998 | A | 2/1989 | Miyawaki | |
| 4,817,176 | A | 3/1989 | Marshall et al. | 382/43 |
| 4,820,909 | A | 4/1989 | Kawaucki et al. | 235/379 |
| 4,823,393 | A | 4/1989 | Kawakami | 382/7 |
| 4,825,246 | A | 4/1989 | Fukuchi et al. | 355/4 |
| 4,827,531 | A | 5/1989 | Milford | 382/7 |
| 4,834,230 | A | 5/1989 | Kondo et al. | 194/206 |
| 4,841,358 | A | 6/1989 | Kammato et al. | 358/75 |
| 4,875,670 | A | 10/1989 | Petersen et al. | |
| 4,881,268 | A | 11/1989 | Uchida et al. | 382/7 |
| 4,905,840 | A | 3/1990 | Yuge et al. | 209/534 |
| 4,906,988 | A | 3/1990 | Copella | 340/825 |
| 4,908,516 | A | 3/1990 | West | 250/556 |
| 4,917,371 | A | 4/1990 | Bastow et al. | |
| 4,973,851 | A | 11/1990 | Lee | 250/556 |
| 4,984,280 | A | 1/1991 | Abe | 382/7 |
| 4,984,692 | A | 1/1991 | Obara | 209/583 |
| 4,985,614 | A | 1/1991 | Pease et al. | 235/440 |
| 4,992,860 | A | 2/1991 | Hamaquchi et al. | 358/75 |
| 4,996,604 | A | 2/1991 | Oqawa et al. | 358/486 |
| 5,012,932 | A | 5/1991 | Omura et al. | 209/534 |
| 5,020,787 | A | 6/1991 | Arikawa | 271/3 |
| 5,027,415 | A | 6/1991 | Hara et al. | 382/135 |
| 5,047,871 | A | 9/1991 | Meyer et al. | 358/486 |
| 5,054,621 | A | 10/1991 | Murphy et al. | 209/534 |
| 5,055,834 | A | 10/1991 | Chiba | 382/135 |
| 5,068,519 | A | 11/1991 | Bryce | 235/449 |
| 5,076,441 | A | 12/1991 | Gerlier | 209/534 |
| 5,105,364 | A | 4/1992 | Kawamura et al. | 364/478 |
| 5,119,025 | A | 6/1992 | Smith et al. | 324/252 |
| 5,122,754 | A | 6/1992 | Gotaas | 324/676 |
| 5,146,067 | A | 9/1992 | Sloan et al. | 235/381 |
| 5,151,607 | A | 9/1992 | Crane et al. | 250/556 |
| 5,163,672 | A | 11/1992 | Mennie | 271/187 |
| 5,167,313 | A | 12/1992 | Dobbins et al. | 194/317 |
| 5,172,907 | A | 12/1992 | Kalisiak | 271/227 |
| 5,183,142 | A | 2/1993 | Latchinian et al. | 194/206 |
| 5,186,334 | A | 2/1993 | Fukudome et al. | 209/531 |

| | | | | |
|---|---|---|---|---|
| 5,199,543 | A | 4/1993 | Kamagami et al. | 194/207 |
| 5,201,395 | A | 4/1993 | Takizawa et al. | 194/206 |
| 5,207,788 | A | 5/1993 | Geib | 271/122 |
| 5,220,395 | A | 6/1993 | Yamashita et al. | 355/313 |
| 5,232,216 | A | 8/1993 | Bybee | |
| 5,236,072 | A | 8/1993 | Cargill | 194/207 |
| 5,240,116 | A | 8/1993 | Stevens et al. | 209/534 |
| 5,261,518 | A | 11/1993 | Bryce | 194/207 |
| 5,295,196 | A | 3/1994 | Raterman et al. | 382/7 |
| 5,297,030 | A | 3/1994 | Vassigh et al. | 364/405 |
| 5,304,813 | A | 4/1994 | DeMan | 250/556 |
| 5,308,992 | A | 5/1994 | Crane et al. | 250/556 |
| 5,309,515 | A | 5/1994 | Troung et al. | 382/7 |
| 5,341,408 | A | 8/1994 | Melcher et al. | 377/8 |
| 5,358,088 | A | 10/1994 | Barnes et al. | 194/206 |
| 5,363,949 | A | 11/1994 | Matsubayashi | 194/206 |
| 5,367,577 | A | 11/1994 | Gotaas | 382/135 |
| 5,394,992 | A | 3/1995 | Winkler | 209/552 |
| 5,397,003 | A | 3/1995 | Stevens et al. | 209/534 |
| 5,402,895 | A | 4/1995 | Mikkelsen et al. | |
| 5,408,417 | A | 4/1995 | Wilder | 364/479 |
| 5,418,458 | A | 5/1995 | Jeffers | 324/235 |
| 5,430,664 | A | 7/1995 | Cargill et al. | 364/550 |
| 5,437,357 | A | 8/1995 | Ota et al. | 385/135 |
| 5,445,277 | A | 8/1995 | Takemoto et al. | 209/534 |
| 5,465,821 | A | 11/1995 | Akioka | 194/207 |
| 5,467,405 | A | 11/1995 | Raterman et al. | 382/135 |
| 5,467,406 | A | 11/1995 | Graves et al. | 382/135 |
| 5,478,992 | A | 12/1995 | Hamada et al. | 235/379 |
| D369,984 | S | 5/1996 | Larsen | D10/97 |
| 5,553,320 | A | 9/1996 | Matsuura et al. | 235/379 |
| 5,607,040 | A | 3/1997 | Mathurin, Sr. | 194/207 |
| 5,616,915 | A | 4/1997 | Simpkins et al. | 250/221 |
| 5,633,949 | A | 5/1997 | Graves et al. | 382/135 |
| 5,639,081 | A | 6/1997 | Hatamachi et al. | 271/177 |
| 5,640,463 | A | 6/1997 | Csulits | 382/135 |
| 5,652,802 | A | 7/1997 | Graves et al. | 382/135 |
| 5,657,846 | A | 8/1997 | Schwartz | 194/206 |
| 5,680,472 | A | 10/1997 | Conant | 382/135 |
| 5,687,963 | A | 11/1997 | Mennie | 271/119 |
| 5,692,067 | A | 11/1997 | Raterman et al. | 382/135 |
| 5,704,491 | A | 1/1998 | Graves | 209/534 |
| 5,724,438 | A | 3/1998 | Graves | 382/135 |
| 5,751,840 | A | 5/1998 | Raterman et al. | 382/135 |
| 5,790,693 | A | 8/1998 | Graves et al. | 382/135 |
| 5,790,697 | A | 8/1998 | Munro et al. | 382/135 |
| 5,806,650 | A | 9/1998 | Mennie et al. | 194/206 |
| 5,815,592 | A | 9/1998 | Mennie et al. | 382/135 |
| 5,822,448 | A | 10/1998 | Graves et al. | 382/135 |
| 5,829,742 | A | 11/1998 | Rabindran et al. | |
| 5,832,104 | A | 11/1998 | Graves et al. | 382/135 |
| 5,867,589 | A | 2/1999 | Graves et al. | 382/135 |
| 5,870,487 | A | 2/1999 | Graves et al. | 382/135 |
| 5,875,259 | A | 2/1999 | Mennie et al. | 382/135 |
| 5,905,810 | A | 5/1999 | Jones et al. | 382/135 |
| 5,912,982 | A | 6/1999 | Munro et al. | 382/135 |
| 5,915,685 | A | 6/1999 | Bausch et al. | |
| 5,917,930 | A | 6/1999 | Kayani et al. | 382/135 |
| 5,938,044 | A | 8/1999 | Weggesser | 209/534 |
| 5,966,456 | A | 10/1999 | Jones et al. | 382/135 |
| 5,993,132 | A | 11/1999 | Harres et al. | |
| 6,012,565 | A | 1/2000 | Mazur | 194/207 |
| 6,021,883 | A | 2/2000 | Casanova et al. | 194/217 |
| 6,028,951 | A | 2/2000 | Raterman et al. | 382/135 |
| 6,074,334 | A | 6/2000 | Mennie et al. | 493/438 |

FOREIGN PATENT DOCUMENTS

| | | | |
|---|---|---|---|
| DE | 2935668 | C2 | 9/1979 |
| EP | 0077464 | A | 4/1983 |
| EP | 101115 | | 2/1984 |
| EP | 130824 | A2 | 6/1984 |
| EP | 130825 | A2 | 6/1984 |
| EP | 132329 | A2 | 6/1984 |
| EP | 206675 | B1 | 6/1986 |
| EP | 253935 | A2 | 10/1986 |
| EP | 264125 | A1 | 10/1987 |
| EP | 325364 | | 7/1989 |
| EP | 0338123 | | 10/1989 |
| EP | 0342647 | A2 | 11/1989 |
| EP | 0342647 | A3 | 11/1989 |
| GB | 2061232 | A | 9/1980 |
| GB | 2119138 | | 2/1983 |
| GB | 2190996 | A | 12/1987 |
| JP | 54-71673 | | 6/1979 |
| JP | 54-71674 | | 6/1979 |
| JP | 56-16287 | | 2/1981 |
| JP | 56-136689 | | 10/1981 |
| JP | 61-14557 | | 4/1986 |
| JP | 61-41439 | | 9/1986 |
| WO | WO 87/06041 | | 10/1987 |
| WO | WO 90/07165 | | 6/1990 |
| WO | WO 91/11778 | | 8/1991 |
| WO | WO 92/17394 | | 10/1992 |
| WO | WO 93/23824 | | 11/1993 |
| WO | WO 94/19773 | | 9/1994 |
| WO | WO 96/10800 | | 4/1996 |

OTHER PUBLICATIONS

Glory GFR–100 Currency Reader Counter Instruction Manual, 32 pp., Aug. 20, 1998.

Glory Brochure "Unstoppable" GFR–100 ReadMaster Currency Discriminator, 2 pp., 8/98.

Glory Brochure "Tank Currency Discriminators" GFR–100 & GFB–700, 2 pp., Aug. 6, 1998.

Glory Brochure "Tank Currency Discriminators" GFR–100 & GFR–S80, 2 pp., Dec. 7, 1999.

Abstract of JP 60–52454.

Abstract of JP 2–302894.

Abstract of JP 3–98945.

Abstract of JP 3–111991.

Abstract of JP 4–275696.

Abstract of JP 05205436 (Publn. No. 07061417 A publ. Mar. 7, 1995).

Abstract of JP 07042545 (Publn. No. 08217269 A publ Aug. 27, 1996).

Abstract of JP 08298522 (Publn. No. 10143711 A publ May 29, 1998).

Abstract of JP 09071514 (Publn. No. 10269396 A publ Oct. 9, 1998).

AFB Currency Recognition System (1982).

Banking Machine Digest No. 31 (last page of C12 translation has a date of Dec. 5, 1988) (Japanese).

First Translation of Banking Machine Digest No. 31 (C11).

Second Translation of Banking Machine Digest No. 31 (C11) (Glory).

Third Translation of Banking Machine Digest No. 31 (C11).

Billcon D–202/204 Service Manual (cover marked 630229) (Japanese).

Translation of Billcon D–202/204 Service Manual—(C15).

Billcon D–202, D204, Operator's Manual (cover marked 611215) (Japanese).

First Translation of Billcon D–202, D204 Operator's Manual (C17).

Second Translation of Billcon D–202, D204 Operator's Manual (C17) (Glory).

Brochure "DeLa Rue Systems, The processing of money and documents," date: copyr. 1987 (See e.g. 3120 Currency Sorting Machine, p. 3).
Brochure: "GFR–X Banknote Counter with Denomination Recognition", date: 12/94; pp. 3.
Brochure of Mosler Model CS 6600 Optical Currency Counter/Sorter, 4 pp., copyr. 1992.
Brochure by Toyocom, "New Currency Counter with Denomination Recognition, Toyocom NS" (Sep. 26, 1994) (1 p.).
Chp. 7 of Mosler CF–420 Cash Management System, Operator's Manual©, 1989.
Cummins–Allison Corp. v. Glory U.S.A., Inc., N.D. Ill. 1998.
Currency Systems International, CPS 1200; 4 pp.; date: copyr. 1992.
Currency Systems International/Currency Processing Systems, CPS 300; 4 pp. date: copyr. 1992.
Currency Systems International, Medium Speed Currency Sorting Family, CPS 600 and CPS 900; 4 pp, date: copyr. 1994.
Currency Systems International, Mr. W. Kranister in Conversation With Richard Haycock; pp. 1–5; dated: estimated 1994.
Declaration of Per Torling, 6 pp. (Mar. 18, 1999).
Description of Currency Systems International's CPS 600 and CPS 900 devices, date: estimated 1994.
Description of Toshiba–Mosler CF–420 Device; estimated 1989.
Drawings of portions of Mosler CF–420 Cash Management System (FIGs. A–C) and description of the same (1989).
Glory GFB–200/210/220/230, Desk–Top Bank Note Counter, 2 pp.; date: estimated before Aug. 9, 1994.
Glory GFF–8CF and GFF–8 Desk–Top Currency and Check Counter, 4 pp.; date: estimated Jan. 14, 1994.
Glory GFR–X Banknote Counter with Denomination Recognition; 3 pp.; date: estimated Jan. 14, 1994.
Glory GFU–100 Desk–Top Currency Fitness Sorter/Counter, 2 pp.; date estimated Jan. 14, 1994.
Glory Instruction Manual for Model GFR–100 Currency Reader Counter, dated Aug. 15, 1995; pp. 26.
Glory UF–1D brochure, 2 pp.; date: estimated before Aug. 9, 1994.
Glory GSA–500 Sortmaster brochure, 2 pp.; date: Jan. 14, 1994.
Glory GSA–500 Sortmaster brochure, 4 pp.; date: estimated Jan. 14, 1994.
JetScan Currency Scanner/Counter, Model 4060, Operator's Manual by Cummins–Allison (8/91).
JetScan Currency Scanner/Counter, Model 4061, Operating Instructions by Cummins–Allison (Apr. 20, 1993).
JetScan Currency Scanner/Counter, Model 4062, Operating Instructions by Cummins–Allison (Nov. 28, 1994).
Mosler CF–420 Cash Management System Operator's Manual, cover, copyright page, and chapter 5 pp. 5–1 through 5–16, copyrighted 1989.
Mosler Inc. Brochure "The Mosler/Toshiba CF–420", 1989.
Mosler–Toshiba Currency Sorter CF–400 Series, 4 pp.; date: copyr. 1983.
News Product News by Toyocom, "Toyocom Currency Counter Now Reads Denominations" (Sep. 26, 1994) (1 p.).
"Offer for Sale of Optical/Magnetic Detection 9/92".
"Sale of Doubles Detection 6/92".
"Sale of Doubles Detection 7/91".
Sale of JetScan Currency Scanner/Counter, Model 4060 (8/91).
Sale of JetScan Currency Scanner/Counter, Model 4061 (Apr. 20, 1993).
Sale of JetScan Currency Scanner/Counter, Model 4062 (Nov. 28, 1994).
"Sale of Magnetic Detection 7/91".
"Sale of Multiple Density Sensitivity Setting 4/93".
"Sale of Multiple Magnetic Sensitivity Setting 4/93".
Toshiba–Mosler Operator's Manual for CF–420 Cash Settlement System: pps 1 to C–3; copyr. 1989 (See eg. pp. 3–10; 4–10; and 5–7).
Toyocom Currency Counter, Model NS–100, "Operation Guide (Preliminary)" (Jun. 13, 1995).
First Translation of JP 61–14557.
Second Translation of JP 61–14557 (Glory).
Translation of JP 54–71673.
Translation of JP 54–71674.
Translation of JP 61–41439.
First Translation of JP 56–136689.
Second Translation of JP 56–136689 (Glory).
Translation of JP 56–16287.
Billcon Brochure: Note Counter with Detection K–100 series.
CSI, Inc. Web Page: CashCat Desktop Sorter and Specifications.
CSI, Inc. Web Page: CPS 300–600 and Specifications.
CSI, Inc. Web Page: CPS 900 and Specifications.
CSI, Inc. Web Page: CPS 1200–1500–1800 and Specifications.
Mosler Brochure: TouchSort Currency (Processing System—One Touch One Pass One Solution).
Toyocom Brochure: NC–50 Currency Counter.
Toyocom Brochure: NS–200 Currency Recognizer.

* cited by examiner

CURRENCY HANDLING SYSTEM HAVING MULTIPLE OUTPUT RECEPTACLES

CROSS-REFERENCE TO RELATED APPLICATIONS

This application is a continuation-in-part of U.S. patent application Ser. No. 09/502,666 entitled "Currency Handling System Having Multiple Output Receptacles," which was filed on Feb. 11, 2000 and is assigned to the assignee of the present application. U.S. patent application Ser. No. 09/502,666 issued as U.S. Pat. No. 6,398,000 on Jun. 4, 2002.

FIELD OF THE INVENTION

The present invention relates generally to the field of currency handling systems and, more particularly, to a multi-pocket currency handling system for discriminating, authenticating, and/or counting currency bills.

BACKGROUND OF THE INVENTION

A variety of techniques and apparatuses have been used to satisfy the requirements of automated currency handling machines. As businesses and banks grow, these businesses are experiencing a greater volume of paper currency. These businesses are continually requiring not only that their currency be processed more quickly but, also, processed with more options in a less expensive manner. At the upper end of sophistication in this area of technology are machines that are capable of rapidly identifying, discriminating, and counting multiple currency denominations and then delivering the sorted currency bills into a multitude of output compartments. Many of these high end machines are extremely large and expensive such that they are commonly found only in large institutions. These machines are not readily available to businesses which have monetary and space budgets, but still have the need to process large volumes of currency. Other high end currency handling machines require their own climate controlled environment which may place even greater strains on businesses having monetary and space budgets.

Currency handling machines typically employ magnetic sensing or optical sensing for denominating and authenticating currency bills. The results of these processes determines to which output compartment a particular bill is delivered to in a currency handling device having multiple output receptacles. For example, ten dollar denominations may be delivered to one output compartment and twenty dollar denominations to another, while bills which fail the authentication test are delivered to a third output compartment. Unfortunately, many prior art devices only have one output compartment which can be appropriately called a reject pocket. Accordingly, in those cases, the reject pocket may have to accommodate those bills which fail a denomination test or authentication test. As a result, different types of "reject" bills are stacked upon one another in the same output compartment leaving the operator unknowing as to which of those bills failed which tests.

Many prior art large volume currency handling devices which positively transport the currency bills through the device are susceptible to becoming jammed. And many of these machines are difficult to un-jam because the operator must physically remove the jammed bill or bills from the device. If necessary, the operator can sometimes manipulate a hand-crank to manually jog the device to remove the bills. Then, the operator must manually turn the hand crank to flush out all the bills from within the system before the batch can be reprocessed. Further compounding the problem in a bill jam situation is that many prior art devices are not equipped to detect the presence of a bill jam. In such a situation, the device continues to operate until the bills pile up and the bill jam is so severe that the device is physically forced to halt. This situation can cause physical damage to both the machine and the bills.

Often, a bill jam ruins the integrity of the count and/or valuation of the currency bills requiring that the entire batch, including those bill already processed into holding and/or storage areas, be reprocessed. Bills need to be reprocessed because prior art devices do not maintain several running totals of bills as bills pass various points within the device. Removing bills from the holding areas and/or storage areas is a time consuming process. For example, a prior device may only count the bills as they are transported through an evaluation region of the currency handing machine. Bills exiting the evaluation region are included in the totals regardless of whether they are involved in bill jams or are successfully transported to an output receptacle. Therefore, when a bill jam occurs those bills involved in the bill jam as well as those bills already transported to the storage areas and/or storage areas have to be reprocessed.

SUMMARY OF THE INVENTION

A method and apparatus for handling bill jams within a currency processing device is provided. The device includes a transport mechanism adapted to transport bills along a transport path, one at a time, from the input receptacle past an evaluation unit into a plurality of output receptacles. At least one of the output receptacles includes a holding area and a storage area. A plurality of bill passage sensors are sequentially disposed along the transport path that are adapted to detect the passage of a bill as each bill is transported past each sensor. An encoder is adapted to produce an encoder count for each incremental movement of the transport mechanism. A controller counts the total number of bills transported into each of the holding areas and the total number of bills moved from a holding area to a corresponding storage area after a predetermined number of bills have been transported into the holding area. The controller tracks the movement of each of the bills along the transport path into each of the holding areas with the plurality of bill passage sensors. The presence of a bill jam is detected when a bill is not transported past one of the plurality of bill passage sensors within a requisite number of encoder counts. The operation of the transport mechanism is suspended upon detection of a bill jam. The bills from each of the holding areas are moved to the corresponding storage areas upon suspension of the operation of the transport mechanism. Remaining bills are then flushed from the transport path after moving the bills from each of the holding areas to the corresponding storage areas upon suspension of the operation of the transport mechanism.

The above summary of the present invention is not intended to represent each embodiment, or every aspect, of the present invention. Additional features and benefits of the present invention will become apparent from the detail description, figures, and claim set forth below.

BRIEF DESCRIPTION OF THE DRAWINGS

Other objects and advantages of the invention will become apparent upon reading the following detailed description in conjunction with the drawings in which.

DETAILED DESCRIPTION OF THE ILLUSTRATED EMBODIMENTS

Figure 1A:
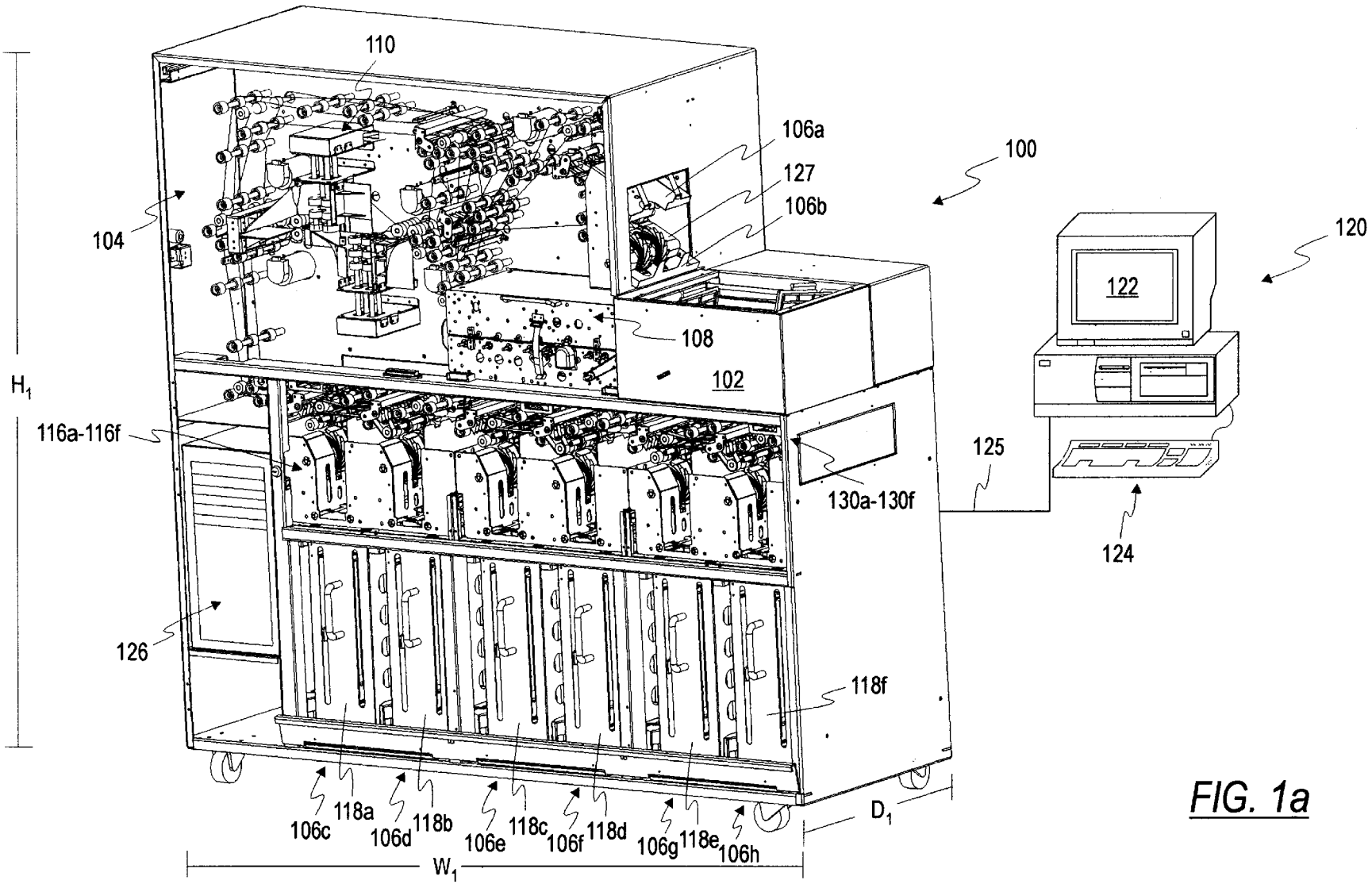
FIG. 1*a* is a perspective view of a document handling device according to one embodiment of the invention.
Figure 1B:
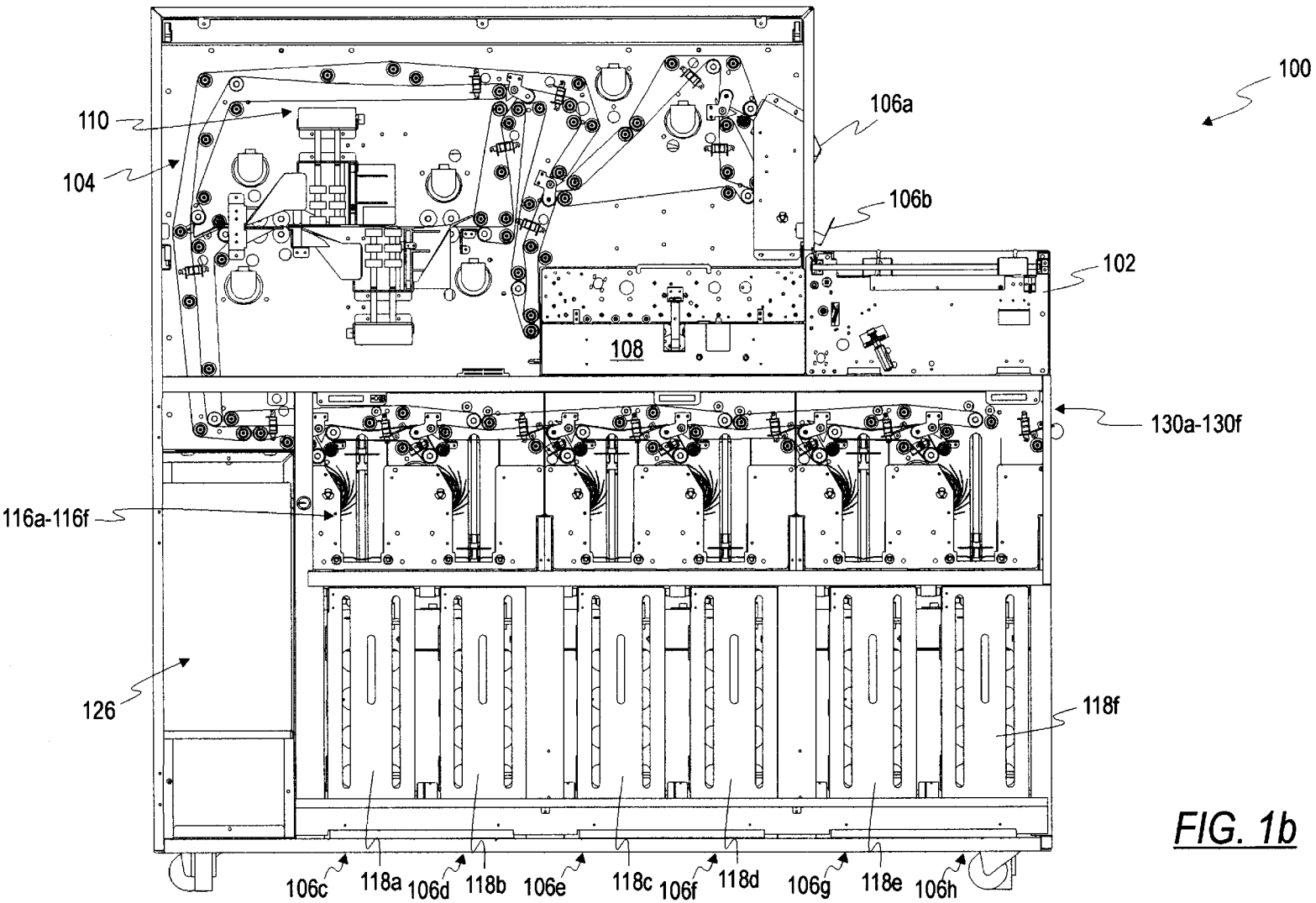
FIG. 1*b* is a front view of a document handling device according to one embodiment of the invention.

Referring to FIGS. 1*a* and 1*b*, a multi-pocket document processing device 100 such as a currency handling device according to one embodiment of the present invention is illustrated. Currency bills are fed, one by one, from a stack of currency bills placed in an input receptacle 102 into a transport mechanism 104. The transport mechanism 104 guides currency bills to one of a plurality of output receptacles 106*a*–106*h*, which may include upper output receptacles 106*a*, 106*b*, as well as lower output receptacles 106*c*–106*h*. Before reaching an output receptacle 106 the transport mechanism 104 guides the bill through an evaluation region 108 where a bill can be, for example, analyzed, authenticated, denominated, counted, and/or otherwise processed. In alternative embodiments of the currency handling device 100 of the present invention, the evaluation region 108 can determine bill orientation, bill size, or whether bills are stacked upon one another. The results of the above process or processes may be used to determine to which output receptacle 106 a bill is directed. The illustrated embodiment of the currency handling device has an overall width, $W_1$, of approximately 4.52 feet (1.38 meters), a height, $H_1$, of approximately 4.75 feet (1.45 meters), and a depth, $D_1$, of approximately 1.67 feet (0.50 meters).

In one embodiment, documents such as currency bills are transported, scanned, denominated, authenticated and/or otherwise processed at a rate equal to or greater than 600 bills per minute. In another embodiment, documents such as currency bills are transported, scanned, denominated, authenticated, and/or otherwise processed at a rate equal to or greater than 800 bills per minute. In another embodiment, documents such as currency bills are transported, scanned, denominated, authenticated and/or otherwise processed at a rate equal to or greater than 1000 bills per minute. In still another embodiment, documents such as currency bills are transported, scanned, denominated, authenticated, and/or otherwise processed at a rate equal to or greater than 1200 bills per minute. In still another embodiment, documents such as currency bills are transported, scanned, denominated, authenticated, and/or otherwise processed at a rate equal to or greater than 1500 bills per minute.

In the illustrated embodiment, interposed in the bill transport mechanism 104, intermediate the bill evaluation region 108 and the lower output receptacles 106*c*–106*h* is a bill facing mechanism designated generally by reference numeral 110. The bill facing mechanism is capable of rotating a bill 180° so that the face position of the bill is reversed. That is, if a U.S. bill, for example, is initially presented with the surface bearing a portrait of a president facing down, it may be directed to the facing mechanism 110, whereupon it will be rotated 180° so that the surface with the portrait faces up. The leading edge of the bill remains constant while the bill is being rotated 180° by the facing mechanism 110. The decision may be taken to send a bill to the facing mechanism 110 when the selected mode of operation or other operator instructions call for maintaining a given face position of bills as they are processed by the currency handling device 100. For example, it may be desirable in certain circumstances for all of the bills ultimately delivered to the lower output receptacles 106*c*–106*h* to have the bill surface bearing the portrait of the president facing up. In such embodiments of the currency handling device 100, the bill evaluation region 108 is capable of determining the face position of a bill, such that a bill not having the desired face position can first be directed to the facing mechanism 110 before being delivered to the appropriate output receptacle 106. Further details of a facing mechanism which may be utilized for this purpose are disclosed in commonly-owned, U.S. Pat. No. 6,047,334, incorporated herein by reference in its entirety, which may be employed in conjunction with the present invention such as the device illustrated in FIGS. 1*a* and 1*b*. Alternatively, the facing mechanism disclosed in commonly-owned U.S. Pat. No. 6,371,303, entitled "Two Belt Bill Facing Mechanism" which was filed on Feb. 11, 2000, incorporated herein by reference in its entirety, may be employed in conjunction with the present invention such as the device illustrated in FIGS. 1*a* and 1*b*. Other alternative embodiments of the currency handling device 100 do not include the facing mechanism 110.

The currency handling device 100 in FIG. 1 a may be controlled from a separate controller or control unit 120 which has a display/user-interface 122, which may incorporate a touch panel display in one embodiment of the present invention, which displays information, including "functional" keys when appropriate. The display/user-interface 122 may be a full graphics display. Alternatively, additional physical keys or buttons, such as a keyboard 124, may be employed. The control unit 120 may be a self-contained desktop or laptop computer which communicates with the currency handling device 100 via a cable 125. The currency handling device 100 may have a suitable communications port (not shown) for this purpose. In embodiments in which the control unit 120 is a desktop computer wherein the display/user-interface 122 and the desktop computer are physically separable, the desktop computer may be stored within a compartment 126 of the currency handling device 100. In other alternative embodiments, the control unit 120 is integrated into the currency handling device 100 so the control unit 120 is contained within the device 100.

The operator can control the operation of the currency handling device 100 through the control unit 120. Through the control unit 120 the operator can direct the bills into specific output receptacles 106*a*–106*h* by selecting various user defined modes. In alternative embodiments, the user can select pre-programmed user defined modes or create new user defined modes based on the particular requirements of the application. For example, the operator may select a user defined mode which instructs the currency handling device 100 to sort bills by denomination, accordingly, the evaluation region 108 would denominate the bills and direct one dollar bills into the first lower output receptacle 106*c*, five dollar bills into the second lower output receptacle 106*d*, ten dollar bills into the third lower output receptacle 106*e*, twenty dollar bills into the forth lower output receptacle 106*f*, fifty dollar bills into the fifth lower output receptacle 106*g*, and one-hundred dollar bills into the sixth lower output receptacle 106*h*. The operator may also instruct the currency handling device 100 to deliver those bills whose denomination was not determined, no call bills, to the first upper output receptacle 106*a*. In such an embodiment, upper output receptacle 106*a* would function as a reject pocket. In an alternative embodiment, the operator may instruct the currency handling device 100 to also evaluate the authenticity of each bill. In such an embodiment, authentic bills would be directed to the appropriate lower output receptacle 106*c*–106*h*. Those bills that were determined not to be authentic, suspect bills, would be delivered to the second upper output receptacle 106*b*. A multitude of user defined modes are disclosed by U.S. Pat. No. 6,278,795 entitled "Multi-Pocket Currency Discriminator" which was filed on Aug. 21, 1997, incorporated herein by reference in its entirety, which may be employed in conjunction with the present invention such as the device illustrated in FIGS. 1*a* and 1*b*.

According to one embodiment, the currency handling device 100 is designed so that when the evaluation region 108 is unable to identify certain criteria regarding a bill, the unidentified note is flagged and "presented" in one of the output receptacles 106*a*–106*h*, that is, the transport mechanism 104 is stopped so that the unidentified bill is located at a predetermined position within one of the output receptacles 106*a*–106*h*, such as being the last bill transported to one of the output receptacles. Such criteria can include denominating information, authenticating information, information indicative of the bill's series, or other information the evaluation region 108 is attempting to obtain pursuant to a mode of operation. Which output receptacles 106*a*–106*h* the flagged bill is presented in may be determined by the user according to a selected mode of operation. For example, where the unidentified bill is the last bill transported to an output receptacle 106*a*–106*h*, it may be positioned within a stacker wheel or positioned at the top of the bills already within the output receptacle 106*a*–106*h*. While unidentified bills may be transported to any output receptacles 106*a*–106*h*, it may be more convenient for the operator to have unidentified bills transported to one of the upper output receptacles 106*a,b* where the operator is able to easily see and/or inspect the bill which has not been identified by the evaluation region 108. The operator may then either visually inspect the flagged bill while it is resting on the top of the stack, or alternatively, the operator may decide to remove the bill from the output receptacle 106 in order to examine the flagged bill more closely. In an alternative embodiment of the currency handling device 100, the device 100 may communicate to the user via the display/user-interface 122 in which one of the output receptacles 106*a*–106*h* a flagged bill is presented.

The currency handling device 100 may be designed to continue operation automatically when a flagged bill is removed from the upper output receptacle 106*a,b* or, according to one embodiment of the present invention, the device 100 may be designed to suspend operation and require input from the user via the control unit 120. Upon examination of a flagged bill by the operator, it may be found that the flagged bill is genuine even though it was not identified as so by the evaluation region 108 or the evaluation may have been unable to denominate the flagged bill. However, because the bill was not identified, the total value and/or denomination counters will not reflect its value. According to one embodiment, such an unidentified bill is removed from the output receptacles 106 and reprocessed or set aside. According to another embodiment, the flagged bills may accumulate in the upper output receptacles 106*a,b* until the batch of currency bills currently being processed is completed or the output receptacle 106*a,b* is full and then reprocessed or set aside.

According to another embodiment, when a bill is flagged, the transport mechanism may be stopped before the flagged bill is transported to one of the output receptacles. Such an embodiment is particularly suited for situations in which the operator need not examine the bill being flagged; for example, the currency handling device 100 is instructed to first process United States currency and then British currency pursuant to a selected mode of operation where the currency handling device 100 processes United States $1, $5, $10, $20, $50, and $100 currency bills into the lower output receptacles 106*c*–106*h*, respectively. Upon detection of the first British pound note, the currency handling device 100 may halt operation allowing the operator to empty the lower output receptacles 106*c*–106*h* and to make any spatial adjustments necessary to accommodate the British currency. A multitude of modes of operation are described in conjunction with bill flagging, presenting, and/or transport halting in commonly owned U.S. Pat. No. 6,278,795 entitled "Method and Apparatus for Document Processing" which was filed on May 28, 1997, incorporated herein by reference in its entirety above, which may be employed in conjunction with the present invention such as the device illustrated in FIGS. 1*a* and 1*b*.

In the illustrated embodiment, with regard to the upper output receptacles 106*a*, 106*b*, the second upper output receptacle 106*b* is provided with a stacker wheel 127 for accumulating a number of bills, while the first upper output receptacle 106*a* is not provided with such a stacker wheel. Thus, when pursuant to a preprogrammed mode of operation or an operator selected mode or other operator instructions, a bill is to be fed to the first upper output receptacle 106*a*, there may be a further instruction to momentarily suspend operation of the currency handling device 100 for the operator to inspect and remove the bill. On the other hand, it may be possible to allow a small number of bills to accumulate in the first upper output receptacle 106*a* prior to suspending operation. Similarly, the second upper output receptacle 106*b* may be utilized initially as an additional one of the lower output receptacles 106*c*–106*h*. However, there is no storage cassette associated with the second upper output receptacle 106*b*. Therefore, when the second upper output receptacle 106*b* is full, operation may be suspended to remove the bills at such time as yet further bills are directed to the second upper output receptacle 106*b* in accordance with the selected mode of operation or other operator instructions. In an alternative embodiment of the currency handling device 100 both the first and the second upper output receptacles 106*a*–*b* are equipped with a stacker wheel. In such an embodiment both the upper output receptacles 106*a*–*b* may also function as the lower output receptacle 106*c*–106*h* allowing a number of bills to be stacked therein; however, in the illustrated embodiment, there are no storage cassettes associated with the upper output receptacles 106*a*–*b*.

Figure 2A:
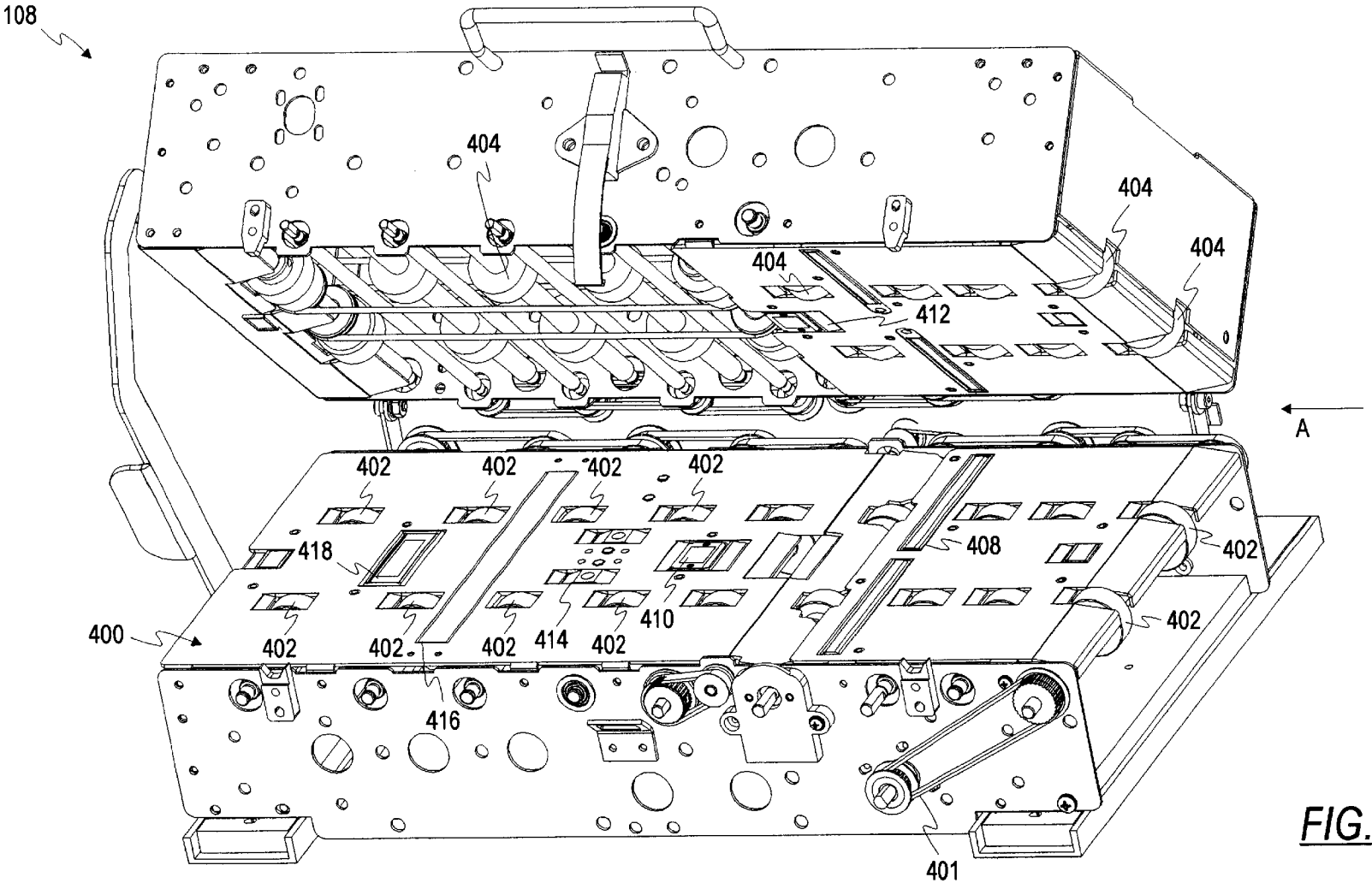
FIG. 2*a* is a perspective view of an evaluation region according to one embodiment of the document handling device of the present invention.
Figure 2B:
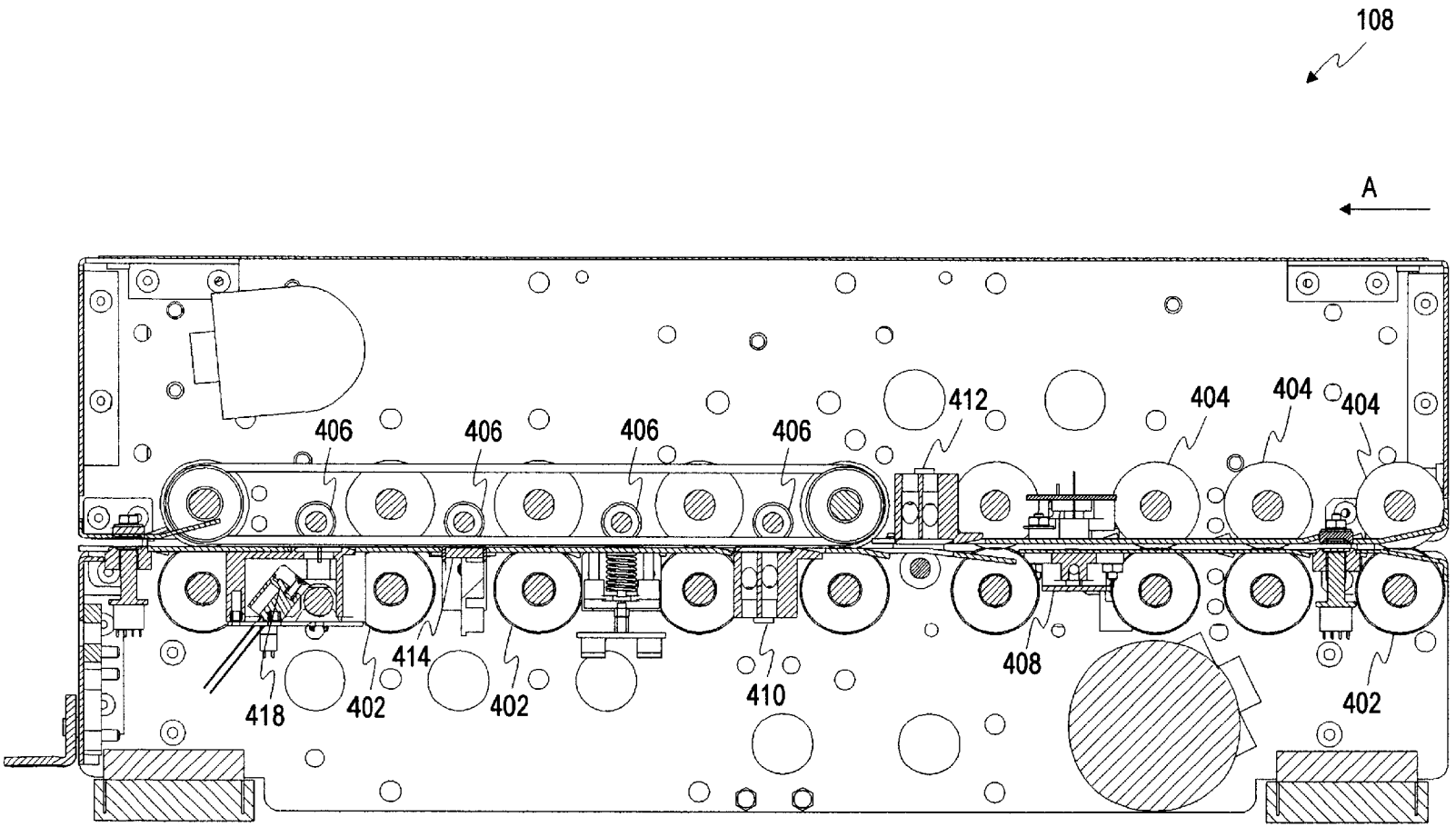
FIG. 2*b* is a side view of an evaluation region according to one embodiment of the document handling device of the present invention.
Figure 3A:
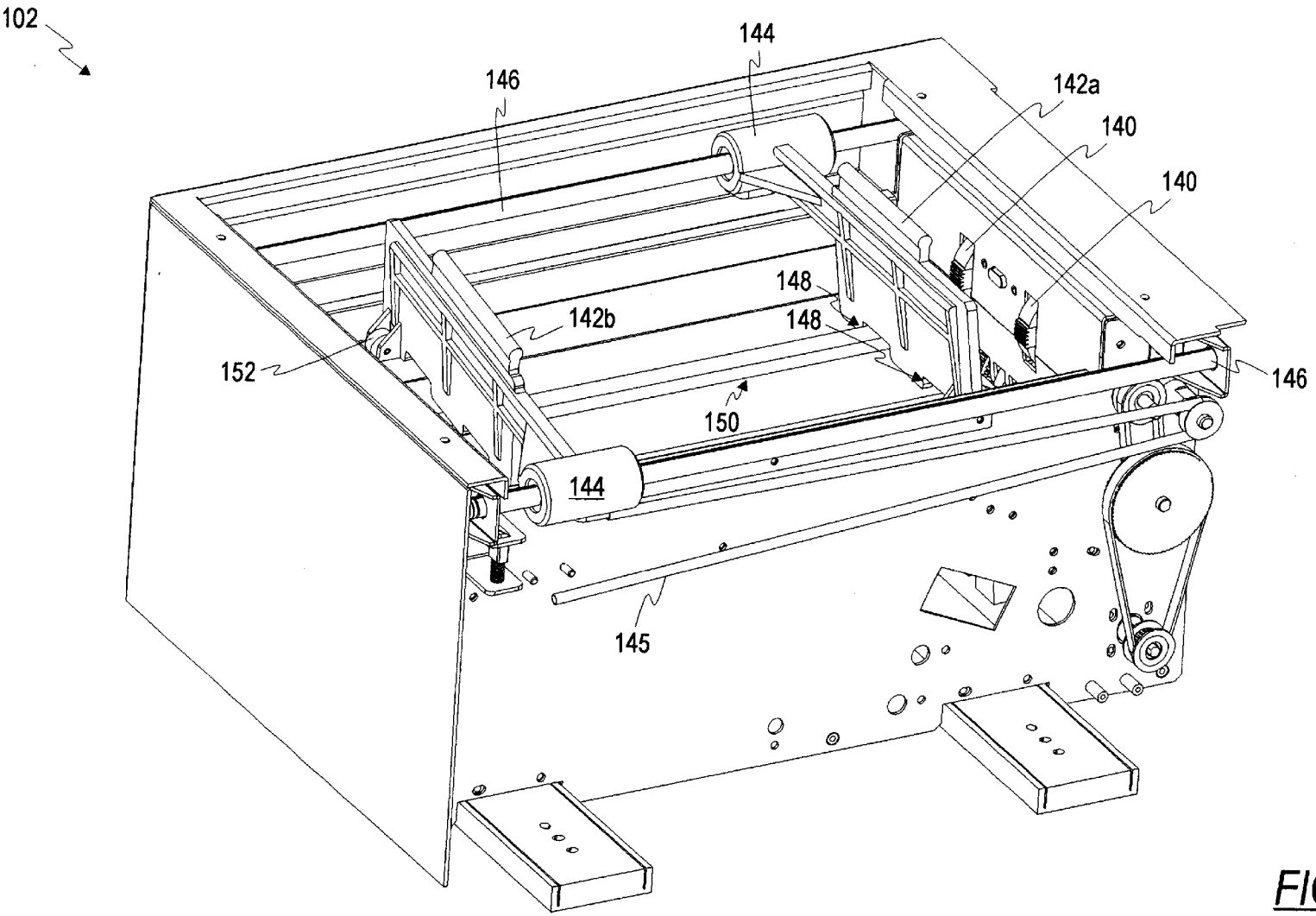
FIG. 3*a* is a perspective view of an input receptacle according to one embodiment of the document handling device of the present invention.
Figure 3B:
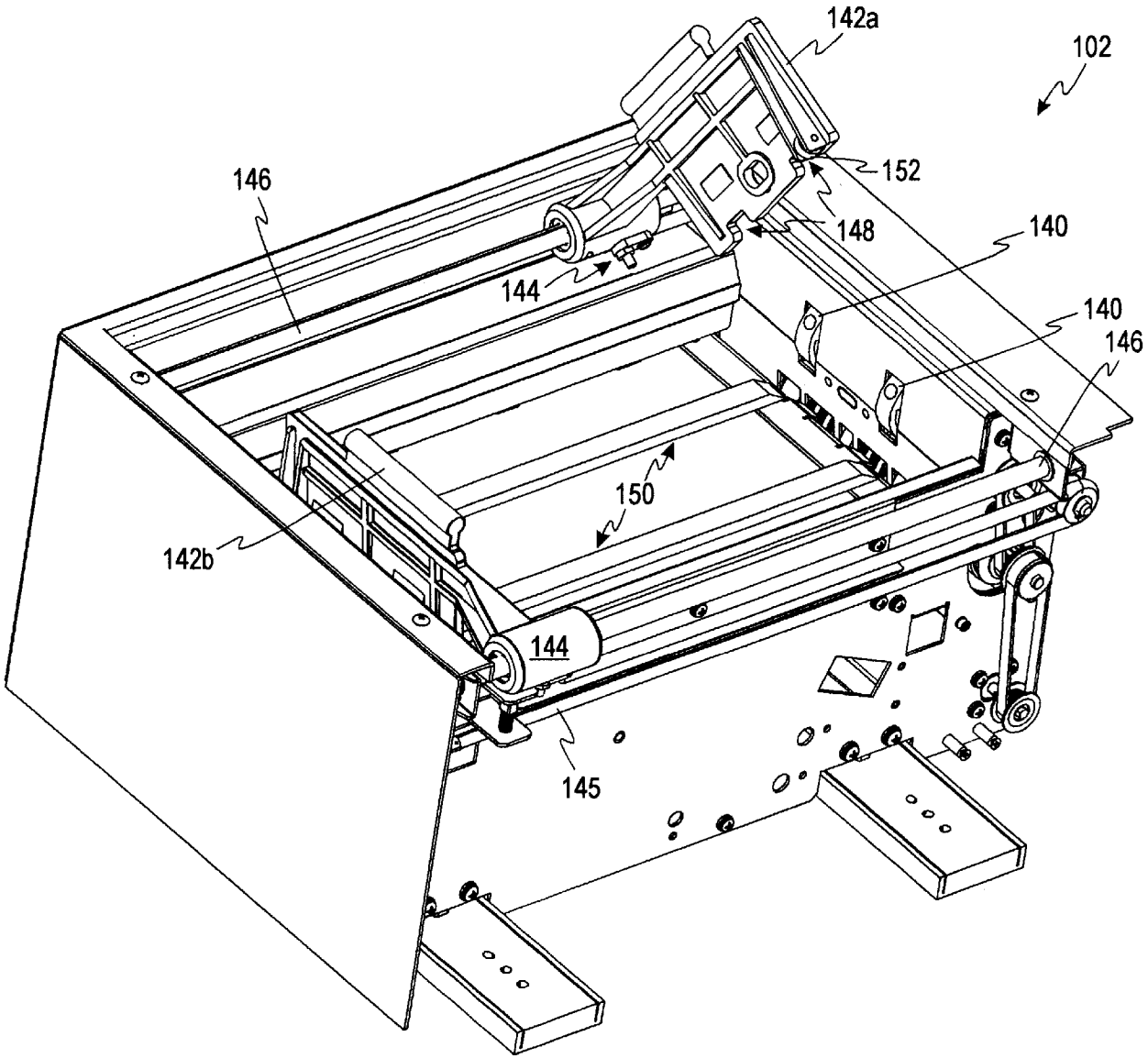
FIG. 3*b* is another perspective view of an input receptacle according to one embodiment of the document handling device of the present invention.
Figure 3C:
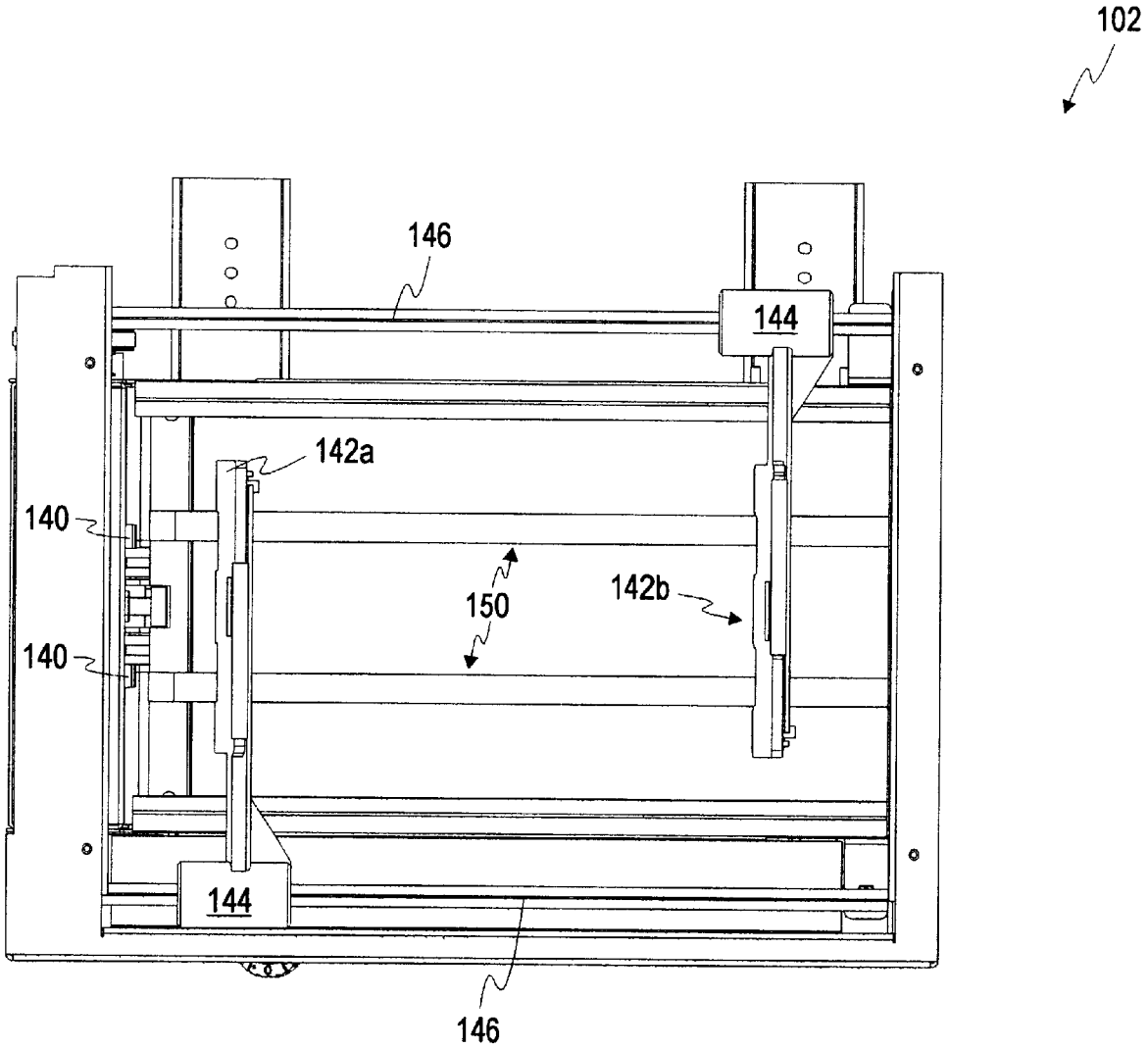
FIG. 3*c* is a top view of an input receptacle according to one embodiment of the document handling device of the present invention.
Figure 3D:
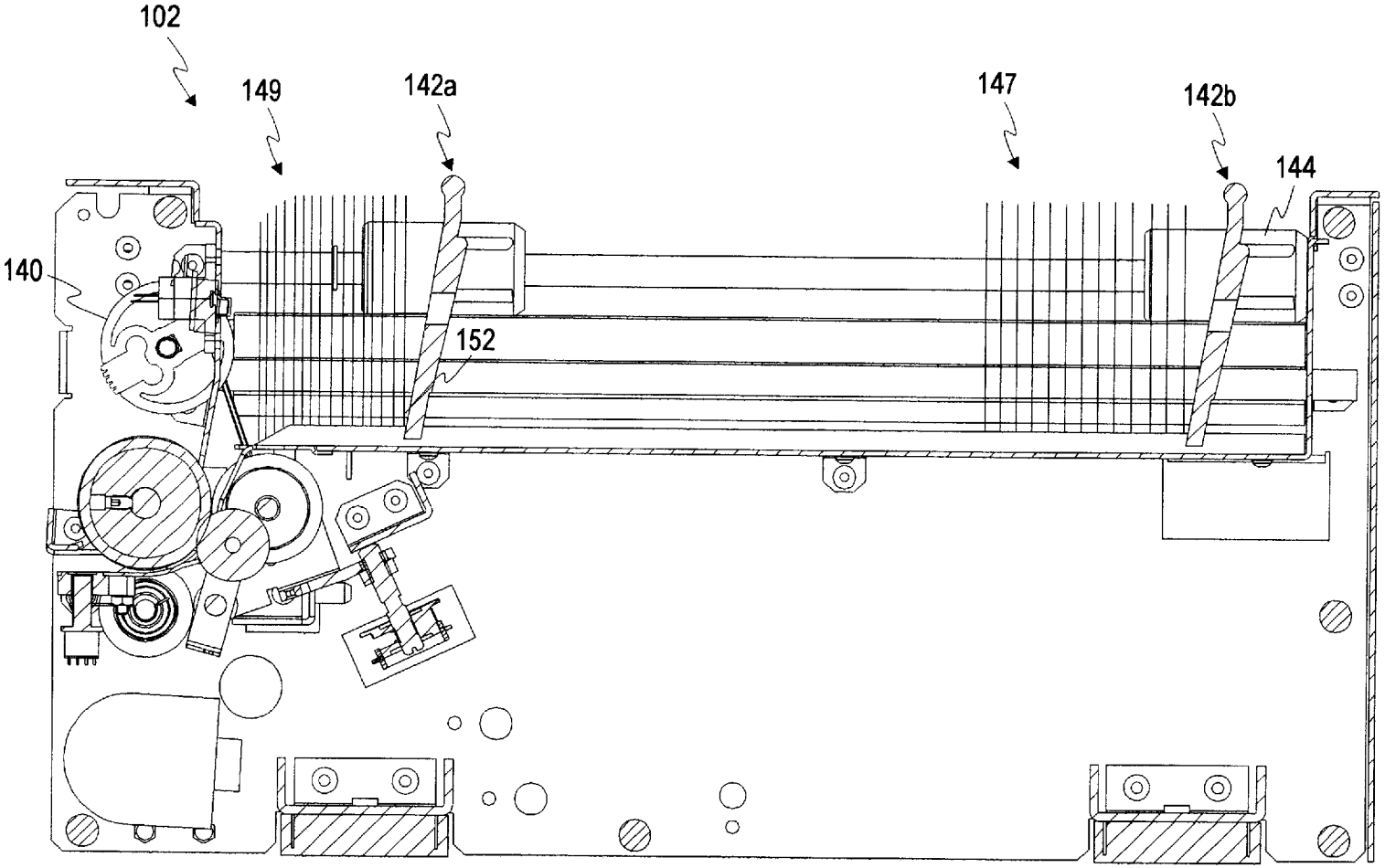
FIG. 3*d* is a side view of an input receptacle according to one embodiment of the document handling device of the present invention.

FIGS. 2*a* and 2*b* illustrate the evaluation region 108 according to one embodiment of the currency handling system 100. The evaluation region can be opened for service, access to sensors, clear bill jams, etc. as shown in FIG. 2*a*. The characteristics of the evaluation region 108 may vary according to the particular application and needs of the user. The evaluation region 108 can accommodate a number and variety of different types of sensors depending on a number of variables. These variables are related to whether the machine is authenticating, counting, or discriminating denominations and what distinguishing characteristics are being examined, e.g. size, thickness, color, magnetism, reflectivity, absorbabilty, transmissivity, electrical conductivity, etc. The evaluation region 108 may employ a variety of detection means including, but not limited to, a size detection and density sensor 408, a lower 410 and an upper 412 optical scan head, a single or multitude of magnetic sensors 414, a thread sensor 416, and an ultraviolet/fluorescent light scan head 418. These detection means and a host of others are disclosed in commonly owned U.S. Pat. No. 6,278,795 entitled "Multi-Pocket Currency Discriminator," incorporated by reference above.

The direction of bill travel through the evaluation region 108 is indicated by arrow A. The bills are positively driven along a transport plate 400 through the evaluation region 108 by means of a transport roll arrangement comprising both driven rollers 402 and passive rollers 404. The rollers 402 are driven by a motor (not shown) via a belt 401. Passive rollers 404 are mounted in such a manner as to be free-wheeling about their respective axis and biased into counter-rotating contact with the corresponding driven rollers 402. The driven and passive rollers 402, 404 are mounted so that they are substantially coplanar with the transport plate 400. The transport roll arrangement also includes compressible rollers 406 to aid in maintaining the bills flat against the transport plate 400. Maintaining the bill flat against the transport plate 400 so that the bill lies flat when transported past the sensors enhances the overall reliability of the evaluation processes. A similar transport arrangement is disclosed in commonly-owned U.S. Pat. No. 5,687,963 entitled "Method and Apparatus for Discriminating and Counting Documents," which is incorporated herein by reference in its entirety.

Referring now to FIGS. 3*a*–3*d*, the input receptacle 102 of the currency handling device 100 is illustrated. A feeder mechanism such as a pair of stripping wheels 140 aid in feeding the bills in seriatim to the transport mechanism 104 which first carries the bills through the evaluation region 108. According to one embodiment, the input receptacle 102 includes at least one spring-loaded feeder paddle 142*a* which is pivotally mounted, permitting it to be pivoted upward and drawn back to the rear of a stack of bills placed in the input receptacle 102 so as to bias the bills towards the evaluation region 108 via the pair of stripping wheels 140. The paddle 142*a* is coupled to an advance mechanism 144 to urge the paddle 142*a* towards the stripping wheels 140. In the illustrated embodiment, motion is imparted to the advance mechanism via a spring 145. In other alternative embodiments, the advance mechanism 144 is motor driven. The advance mechanism 144 is slidably mounted to a shaft 146. The advance mechanism 144 also constrains the paddle 142*a* to a linear path. The advance mechanism 144 may contain a liner bearing (not shown) allowing the paddle 142*a* to easily slide along the shaft 146. In the embodiment illustrated, the paddle 142*a* may also contain channels 148 to aid in constraining the paddle 142*a* to a linear path along a pair of tracks 150. The paddle 142*a* may additionally include a roller 152 to facilitate the movement of the paddle 142*a*.

In the embodiment illustrated in FIGS. 3*a*–3*d*, a second paddle 142*b* is provided such that a second stack of bills 147 may be placed in the input receptacle 102 behind a first group of bills 149, while the first group of bills 149 is being fed into the currency handling device 100. Thus, the two feeder paddles 142*a* and 142*b* may be alternated during processing in order to permit multiple stacks of currency bills to be loaded into the input receptacle 102. In such an embodiment, the operator would retract paddle 142*a* and place a stack of bills into the input receptacle. Once inside the input receptacle, the operator would place the paddle 142*a* against the stack of bills so that the paddle 142*a* biases the stack of bills towards the pair of stripper wheels 140. The operator could then load a second stack of bills into the input receptacle 102 by retracting the second paddle 142*b* and placing a stack of bills in the input receptacle between the paddles 142*a* and 142*b*. The second paddle 142*b* urges the second stack of bills up against the backside of the first paddle 142*a*. The operator can then upwardly rotate the first paddle 142*a* thus combining the two stacks. The first paddle 142*a* is then retracted to the rear of the input receptacle and the process can be repeated. The two paddle input receptacle allows the operator to more easily continuously feed stacks of bills to the currency handling device 100. In devices not having two feeder paddles, the operator is forced to awkwardly manipulate the two stacks of bills and the advance mechanism. Alternatively, the operator may wait for the stack of bills to be processed out of the input receptacle to add another stack; however, waiting to reload until each stack is processed adds to the total time to process a given amount of currency.

Figure 4:
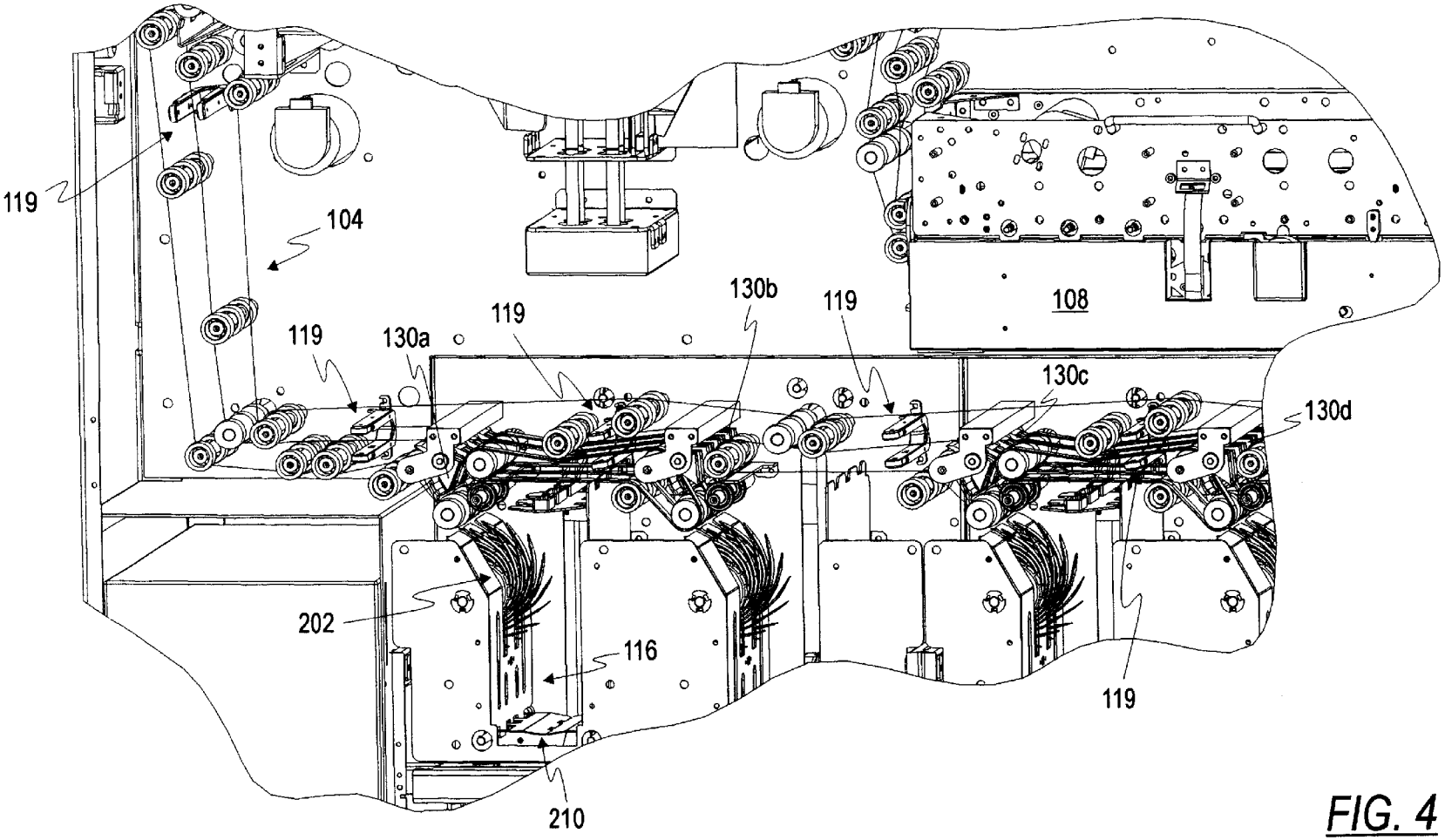
FIG. 4 is a perspective view of a portion of a transportation mechanism according to one embodiment of the present invention.

Referring to FIG. 4, a portion of the transport mechanism 104 and diverters 130*a*–130*d* are illustrated. A substantial portion of the transport path of the currency handling device 100 positively grips the bills during transport from the pair of stripping wheels 140 through the point where bills are delivered to upper output receptacle 106*a* or are delivered to the stacker wheels 202 of output receptacles 106*b*–106*h*. The positive grip transport path of the currency handling device 100 is less costly and weighs less than the vacuum transport arrangements of prior currency processing devices.

The transport mechanism 104 is electronically geared causing all sections to move synchronously from the evaluation region 108 through the point where the bills are delivered to the output receptacles 106. Multiple small motors are used to drive the transport mechanism 104. Using multiple small, less costly motors is more efficient and less costly than a single large motor. Further, less space is consumed enabling the currency handling device 100 to be more compact. Electronically gearing the transport mechanism 104 enables a single encoder to monitor bill transportation within the currency handling system 100. The encoder is linked to the bill transport mechanism 104 and provides input to a processor to determine the timing of the operations of the currency handling device 100. In this manner, the processor is able to monitor the precise location of the bills as they are transported through the currency handling device 100. This process is termed "flow control." Input from additional sensors 119 located along the transport mechanism 104 of the currency handling device 100 enables the processor to continually update the position of a bill within the device 100 to accommodate for bill slippage. When a bill leaves the evaluation region 108 the processor expects the bill to arrive at the diverter 130*a* corresponding to the first lower output receptacle 106*c* after a precise number of encoder counts. Specifically, the processor expects the bill to flow past each sensor 119 positioned along the transport mechanism 104 at a precise number of encoder counts. If the bill slips during transport but passes a sensor 119 later within an acceptable number of encoder counts the processor updates or "re-queues" the new bill position. The processor calculates a new figure for the time the bill is expected to pass the next sensor 119 and arrive at the first diverter 130*a*. The processor activates the one of the diverters 130*a*–*f* to direct the bill into the appropriate corresponding lower output receptacle 106*c*–106*h* when the sensor 119 immediately preceding the diverter 130 detects the passage of the bill to be directed into the appropriate lower output receptacle 106*c*–*h*.

The currency handling device 100 also uses flow control to detect bill jams within the transport mechanism 104 of the device 100. When a bill does not reach a sensor 119 within in the calculated number of encoder counts plus the maximum number of counts allowable for slippage, the processor suspends operation of the device 100 and informs the operator via the display/user-interface 122 that a bill jam has occurred. The processor also notifies the operator via the display/user-interface 122 of the location of the bill jam by indicating the last sensor 119 that the bill passed and generally the approximate location of the bill jam in the system. If the operator cannot easily remove the bill without damage, the operator can then electronically jog the transport path in the forward or reverse direction via the control unit 120 so that the jammed bill is dislodged and the operator can easily remove the bill from the transport path. The operator can then flush the system causing the transport mechanism 104 to deliver all of the bills currently within the transport path of the currency handling device 100 to one of the output receptacles 106. In an alternative embodiment, the user of the currency handling device 100 would have the option when flushing the system to first have the bills already within the escrow regions 116*a*–116*f* to be delivered to the respective lower storage cassettes 106*c*–106*h* so that those bills may be included in the aggregate value data for the bills being processed. The bills remaining in the transport path 104 would then be delivered to a predetermined escrow region 116 where those bills could be removed and reprocessed by placing those bills in the input receptacle 102.

Utilizing flow control to detect bill jams is more desirable than prior art currency evaluation machines which do not detect a bill jam until a sensor is actually physically blocked. The latter method of bill jam detection permits bills to pile up while waiting for a sensor to become blocked. Bill pile-up is problematic because it may physically halt the machine before the bill jam is detected and may cause physical damage to the bills and the machine. In order to remedy a bill jam in a prior art machine, the operator must first manually physically dislodge the jammed bills. The operator must then manually turn a hand crank which advances the transport path until all bills within the transport path are removed. Moreover, because the prior art devices permit multiple bills to pile up before a bill jam is detected, the integrity of the process is often ruined. In such a case, the entire stack of bills must be reprocessed.

Referring back to FIG. 1*a*, the illustrated embodiment of the currency handling device 100 includes a total of six lower output receptacles 106*c*–106*h*. More specifically, each of the lower output receptacles 106*c*–106*h* includes a first portion designated as an escrow compartment 116*a*–116*f* and a second portion designated as a storage cassette 118*a*–118*f*. Typically, bills are initially directed to the escrow compartments 116, and thereafter at specified times or upon the occurrence of specified events, which may be selected or programmed by an operator, bills are then fed to the storage cassettes 118. The storage cassettes are removable and replaceable, such that stacks of bills totaling a predetermined number of bills or a predetermined monetary value may be accumulated in a given storage cassette 118, whereupon the cassette may be removed and replaced with an empty storage cassette. In the illustrated embodiment, the number of lower output receptacles 106*c*–106*h* including escrow compartments 116 and storage cassettes 118 are six in number. In alternative embodiments, the currency handling device 100 may contain more or less than six lower output receptacles including escrow compartments and storage cassettes 118. In other alternative embodiments, modular lower output receptacles 106 can be implemented to add many more lower output receptacles to the currency handling system 100. Each modular unit may comprise two lower output receptacles. In other alternative embodiments, several modular units may be added at one time to the currency handling device 100.

A series of diverters 130*a*–130*f*, which are a part of the transportation mechanism 104, direct the bills to one of the lower output receptacles 106*c*–106*h*. When the diverters 130 are in an upper position, the bills are directed to the adjacent lower output receptacle 106. When the diverters 130 are in a lower position, the bills proceed in the direction of the next diverter 130.

Figure 5:
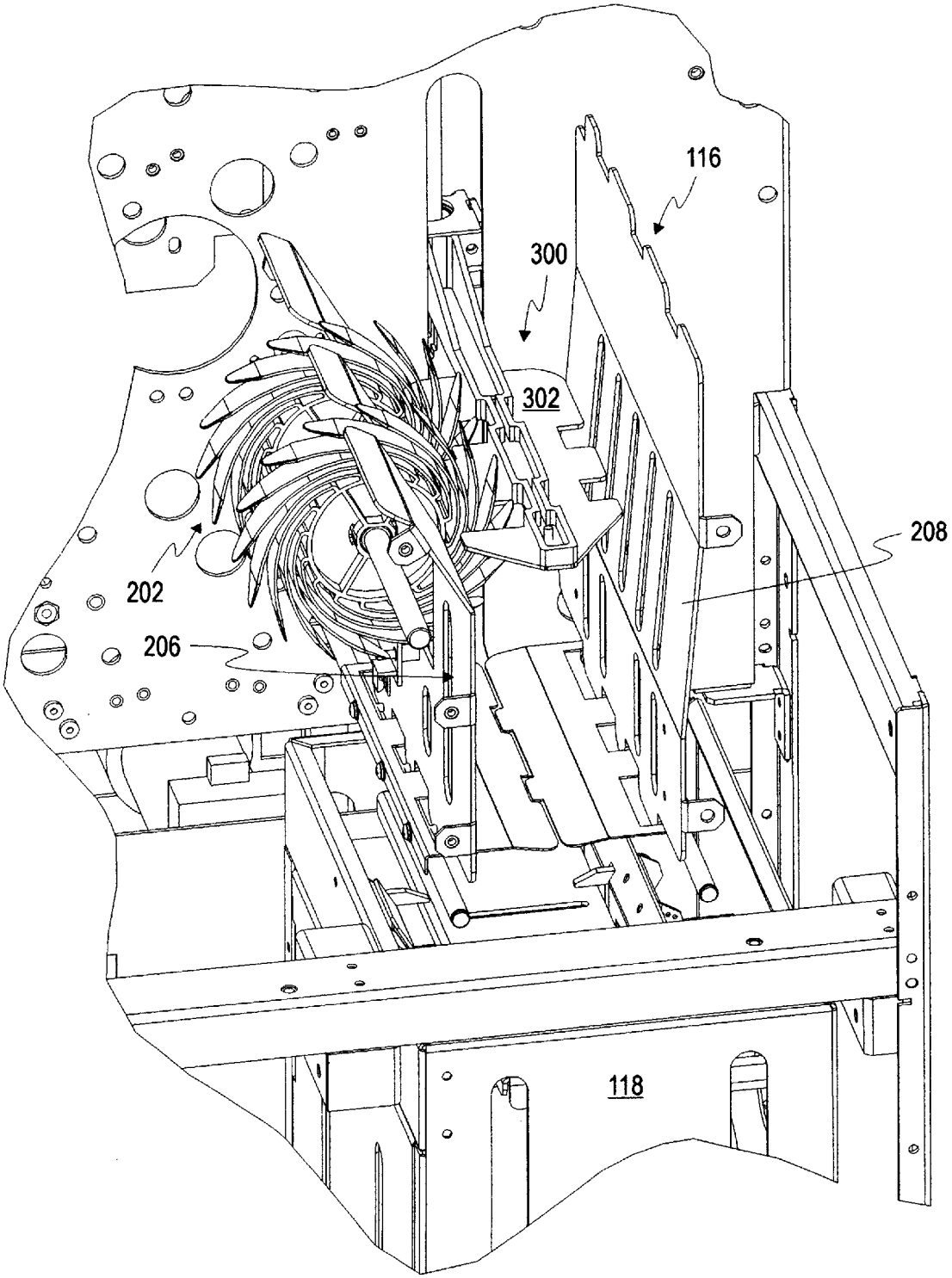
FIG. 5 is a front perspective view of an escrow compartment, a plunger assembly, and a storage cassette according to one embodiment of the document handling device of the present invention.

The vertical arrangement of the lower output receptacles 106*c*–106*h* is illustrated in FIG. 5. The escrow compartment 116 is positioned above the storage cassette 118. In addition to the escrow compartment 116 and the storage cassette 118, each of the lower output receptacles 106*c*–106*h* contains a plunger assembly 300. The plunger assembly 300 is shown during its decent towards the storage cassette 118.

Figure 6:
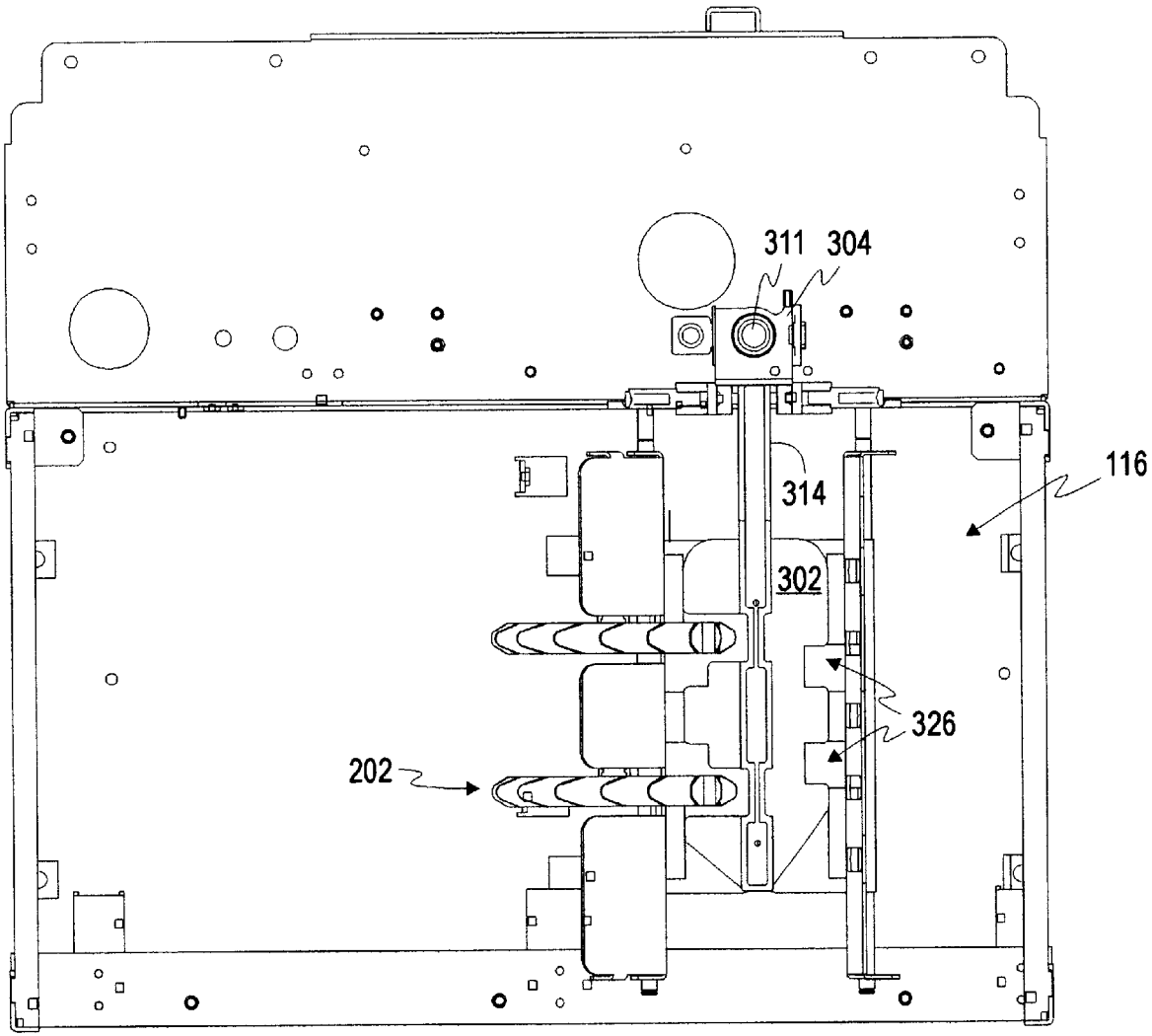
FIG. 6 is a top view of an escrow compartment and plunger assembly according to one embodiment of the document handling device of the present invention.
Figure 7:
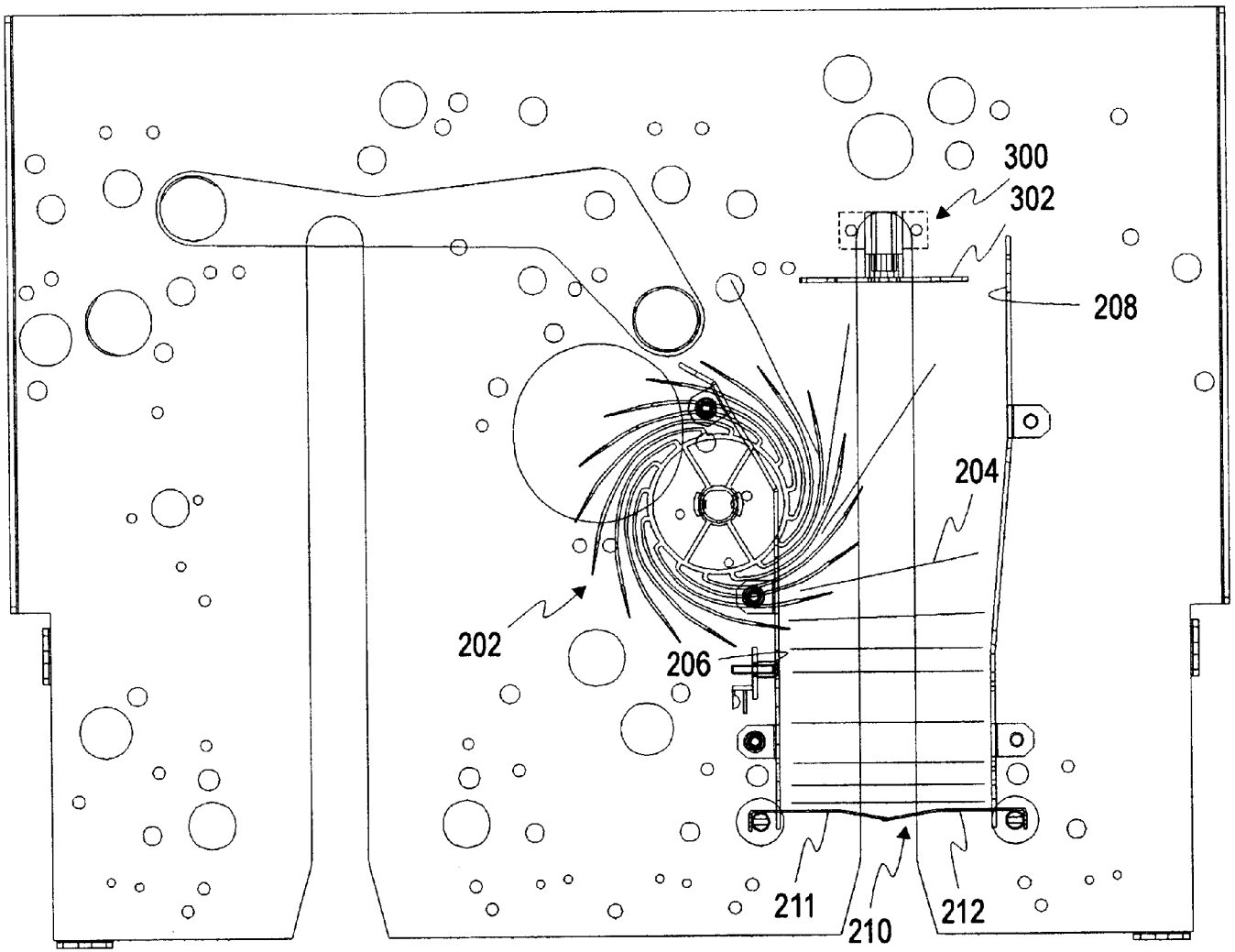
FIG. 7 is a front view of an escrow compartment and plunger assembly according to one embodiment of the document handling device of the present invention.

Referring now to FIGS. 6 and 7, one of the escrow compartments 116 of the lower output receptacles 106*c*–106*h* is shown. The escrow compartment 116 contains a stacker wheel 202 to receive the bills 204 from the diverter 130. The stacker wheel 202 stacks the bills 204 within the escrow compartment walls 206, 208 on top of a gate 210 disposed between the escrow compartment 116 and the storage cassette 118. In an alternative embodiment, the escrow compartment 116 contains a pair of guides to aid in aligning the bills substantially directly on top of one another. The gate 210 is made up of two shutters: a first shutter 211 and a second shutter 212. The shutters 211, 212 are hingedly connected enabling the shutters 211, 212 to rotate downward approximately ninety degrees to move the gate from a first position (closed position) wherein the shutters 211, 212 are substantially co-planer to a second position (open position) wherein the shutters 211, 212 are substantially parallel. Below the gate 210 is the storage cassette 118 (not shown in FIGS. 6 and 7).

Figure 8:
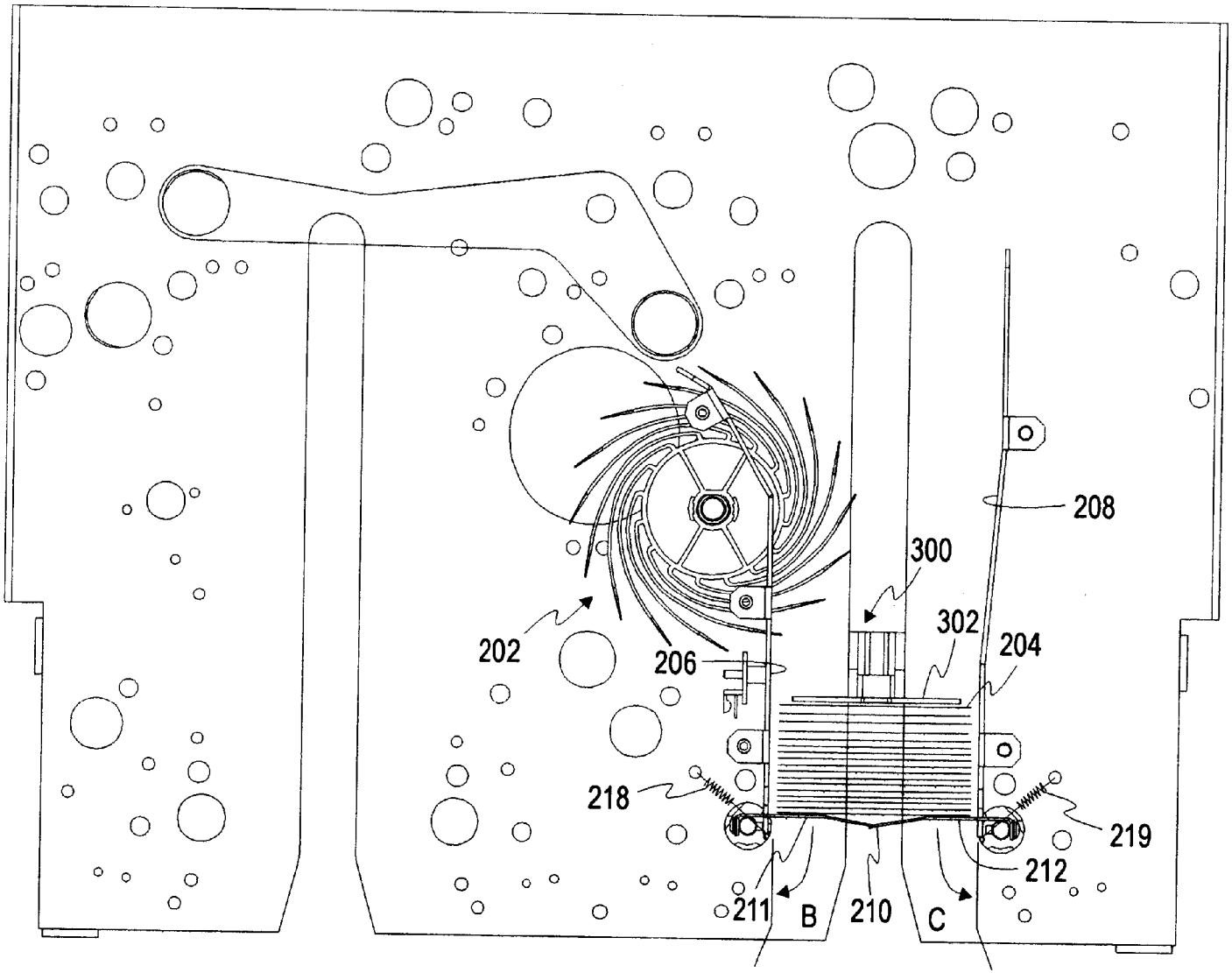
FIG. 8 is another front view of an escrow compartment and plunger assembly according to one embodiment of the document handling device of the present invention.

FIG. 8 illustrates the positioning of the paddle 302 when transferring a stack of bills from the escrow compartment 116 to the storage cassette 118. When the paddle descends upon the stack of bills 204 it causes shutters 211, 212 to quickly rotate in the directions referred to by arrows B and C, respectively; thus, "snapping" open the gate 210. The quick rotation of the shutters 211, 212 insures that the bills fall into the storage cassette 118 in a substantially stacked position. According to one embodiment, the paddle is programmed to descend after a predetermined number of bills 204 are stacked upon the gate 210. According to other embodiments, the operator can instruct the paddle 302 via the control unit 120 to descend upon the bills 204 stacked upon the gate 210.

Figure 9:
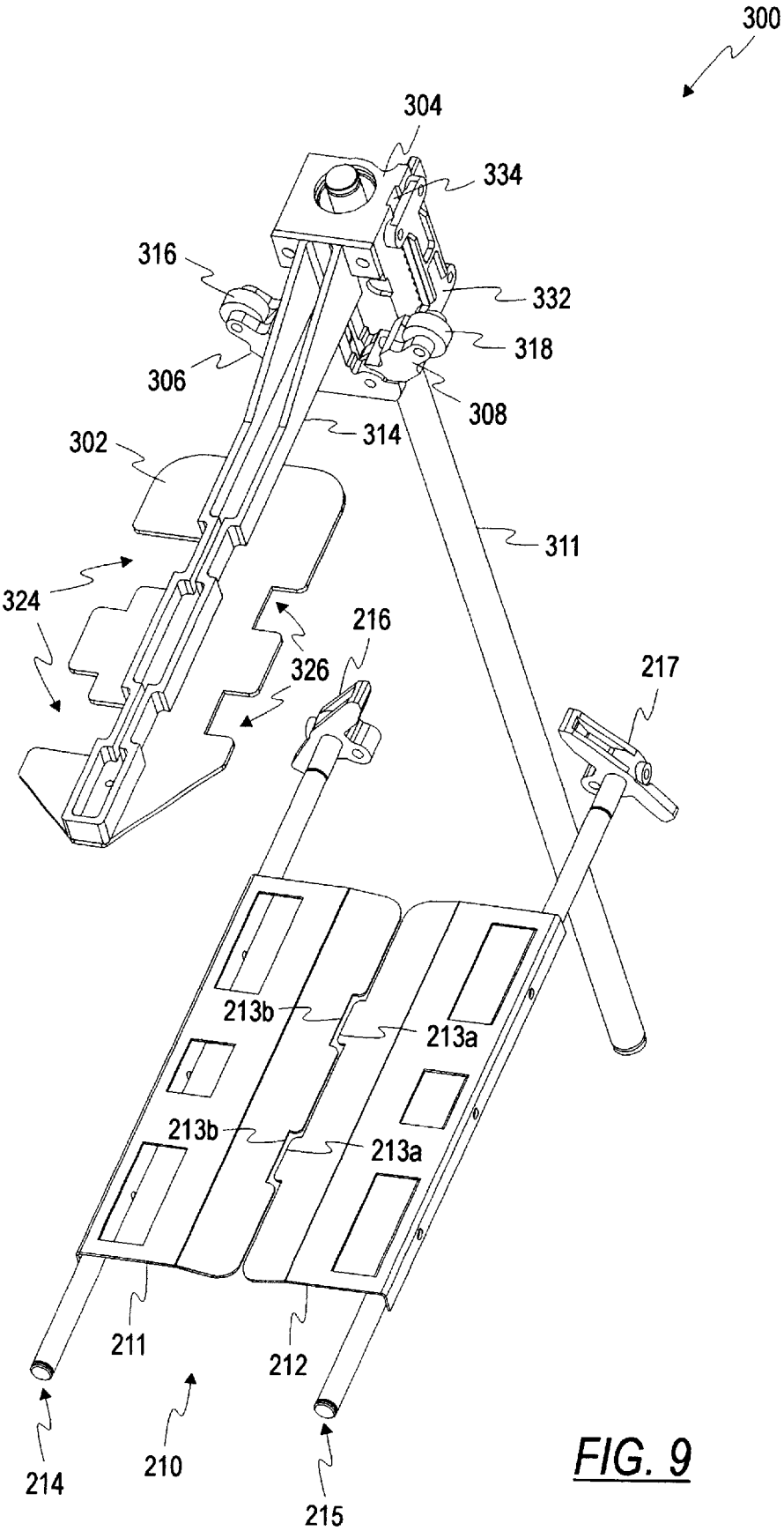
FIG. 9 is a perspective view of an apparatus for transferring currency from an escrow compartment to a storage cassette according to one embodiment of the document handling device of the present invention.

Referring now to FIG. 9, the plunger assembly 300 for selectively transferring the bills 204 from an escrow compartment 116 to a corresponding storage cassette 118 and the gate 210 are illustrated in more detail. One such plunger assembly 300 is provided for each of the six lower output receptacles 106*c*–106*h* of the currency handling device 100. The plunger assembly 300 comprises a paddle 302, a base 304, and two side arms 306, 308. Each of the shutters 211, 212 comprising the gate 210 extend inwardly from corresponding parallel bars 214, 215. The bars 214, 215 are mounted for pivoting the shutters between the closed position and the open position. Levers 216, 217 are coupled to the parallel bars 214, 215, respectively, to control the rotation of the bars 214, 215 and hence of the shutters 211, 212. Extension springs 218, 219 (shown in FIG. 8) tend to maintain the position of the levers 216, 217 both in the closed and open positions. The shutters 211, 212 have an integral tongue 213*a* and groove 213*b* arrangement which prevents any bills which are stacked upon the gate 210 from slipping between the shutters 211, 212.

The base 304 travels along a vertical shaft 311 with which it is slidably engaged. The base 304 may include linear bearings (not shown) to facilitate its movement along the vertical shaft 311. The plunger assembly 300 may also include a vertical guiding member 312 (see FIG. 11) with which the base 304 is also slidably engaged. The vertical guiding member 312 maintains the alignment of the plunger assembly 300 by preventing the plunger assembly 300 from twisting laterally about the vertical shaft 311 when the paddle 302 forces the bills 204 stacked in the escrow area 116 down into a storage cassette 118.

Figure 10:
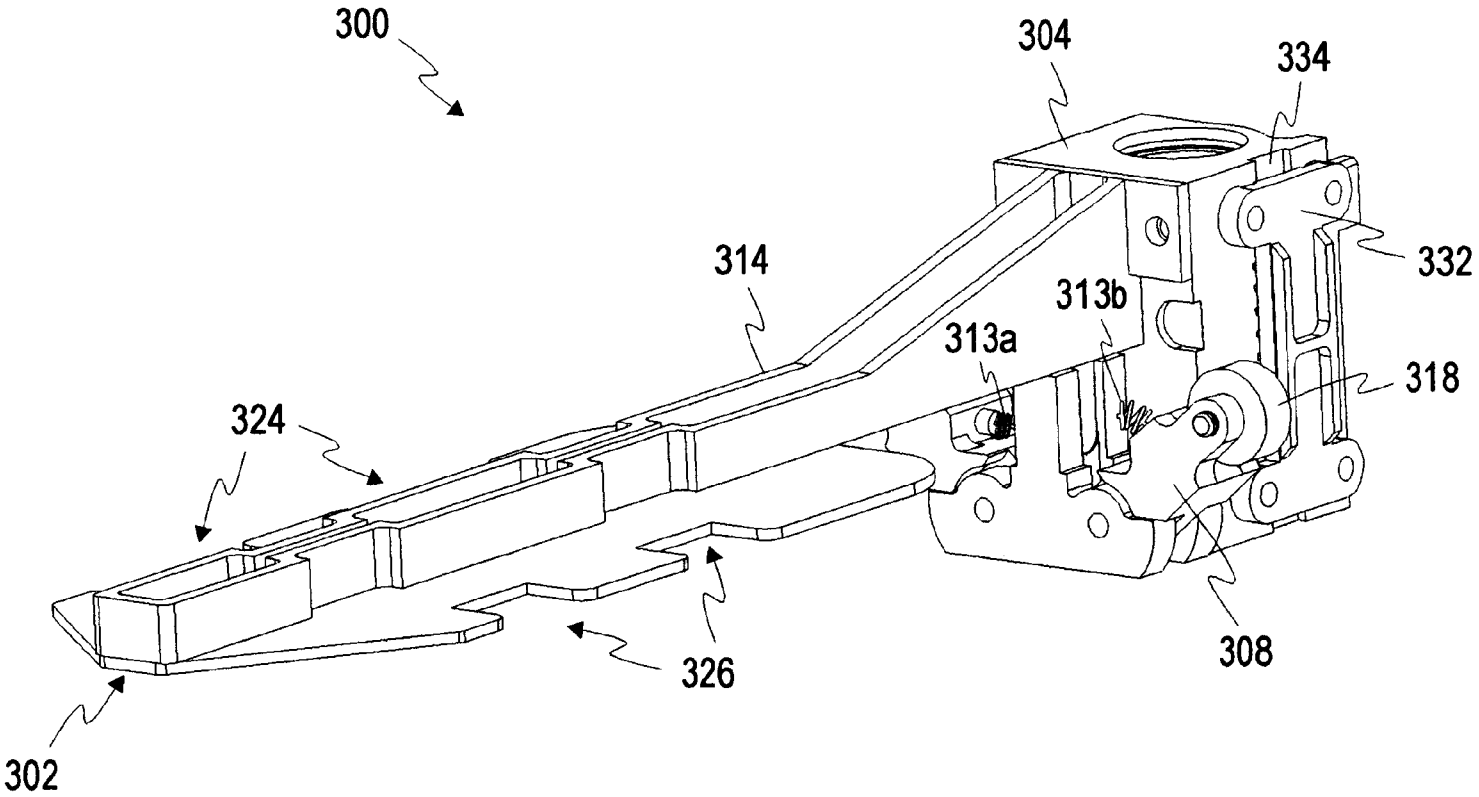
FIG. 10 is a perspective view of a paddle according to one embodiment of the document handling device of the present invention.

Referring also to FIG. 10, the paddle 302 extends laterally from the base 304. The paddle 302 is secured to a support 314 extending from the base 304. A pair of side arms 306, 308 are hingedly connected to the base. Each of the side arms 306, 308 protrude from the sides of the base 304. Rollers 316, 318 are attached to the side arms 306, 308, respectively, and are free rolling. Springs 313*a*, 313*b* are attached to the side arms 306, 308, respectively, to bias the side arms 306, 308 outward from the base 304. In the illustrated embodiment, the spring 313*a*, 313*b* are compression springs.

The paddle 302 contains a first pair of slots 324 to allow the paddle to clear the stacker wheel 202 when descending into and ascending out of the cassette 118. The first pair of slots 324 also enables the paddle 302 to clear the first pair of retaining tabs 350 within the storage cassette (see FIG. 14). Similarly, paddle 302 contains a second pair of slots 326 to enable the paddle 302 to clear the second pair of retaining tabs 350 within the storage cassette 118 (see FIG. 14).

Figure 11:
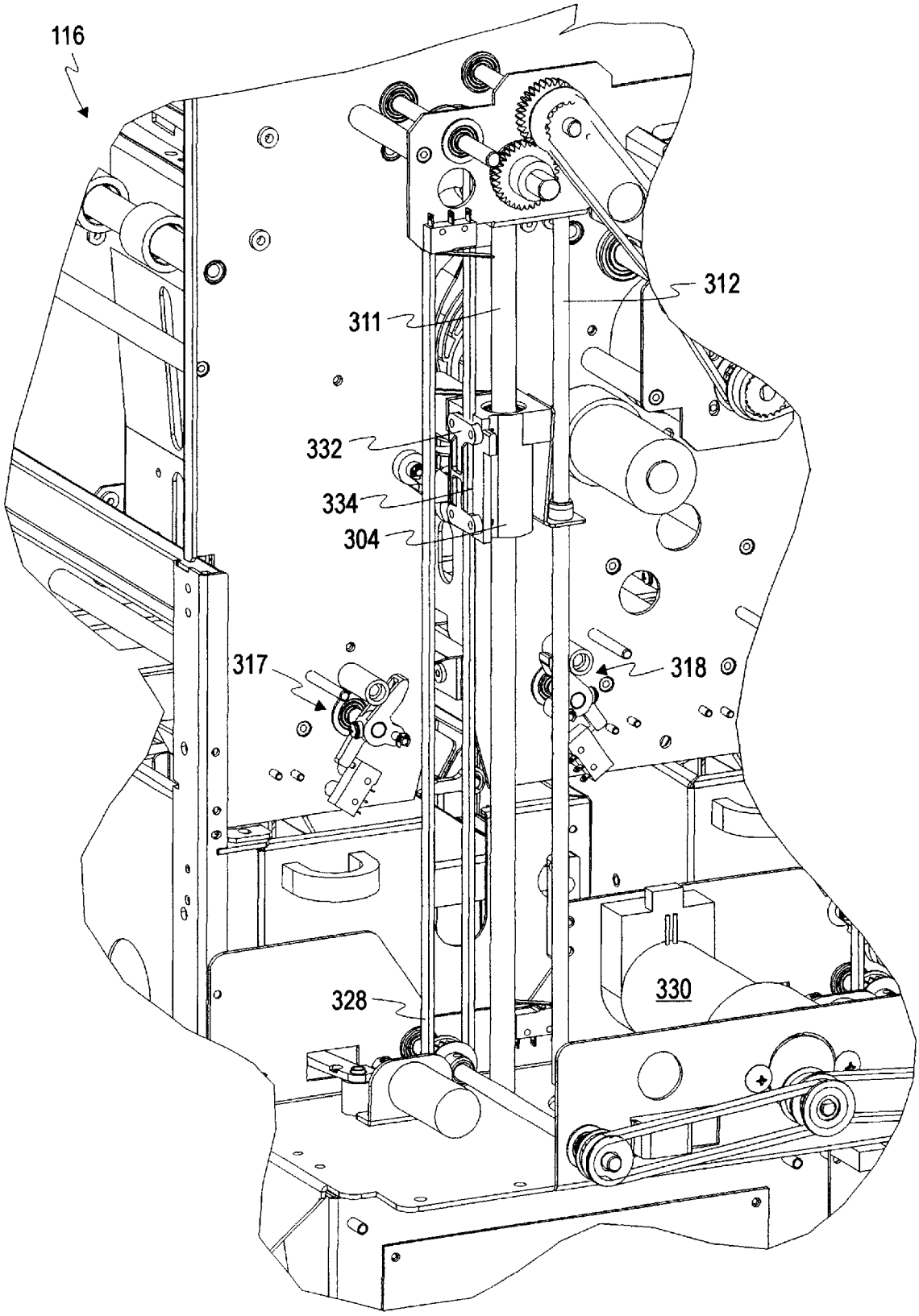
FIG. 11 is a rear perspective view of the escrow compartment, plunger assembly, and storage cassette according to one embodiment of the document handling device of the present invention.

Referring now to FIG. 11, which illustrates a rear view of one of the lower output receptacles 106*c*–106*h*, the plunger 300 is bidirectionally driven by way of a belt 328 coupled to an electric motor 330. A clamp 332 engages the belt 328 into a channel 334 in the base 304 of the plunger assembly 300. In the embodiment illustrated in FIG. 11, two plunger assemblies 300 are driven by a single electric motor 330. In one embodiment of the currency handling device, the belt 328 is a timing belt. In other alternative embodiments, each plunger assembly 300 can be driven by a single electric motor 330. In still other alternative embodiments, there can be any combination of motors 330 to plunger assemblies 300.

Figure 12:
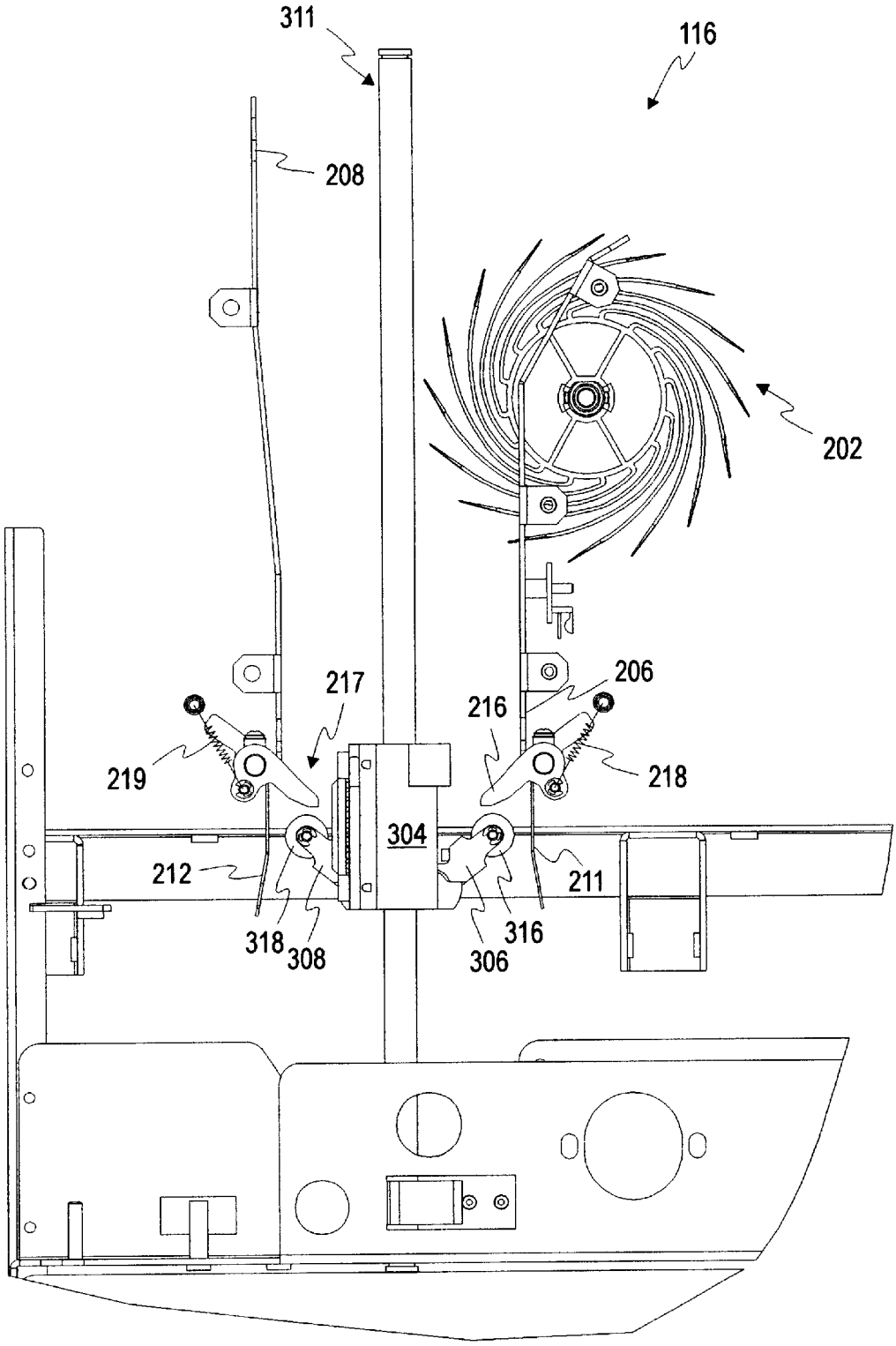
FIG. 12 is a rear view of a plunger assembly wherein the gate is in the open position according to one embodiment of the document handling device of the present invention.
Figure 13:
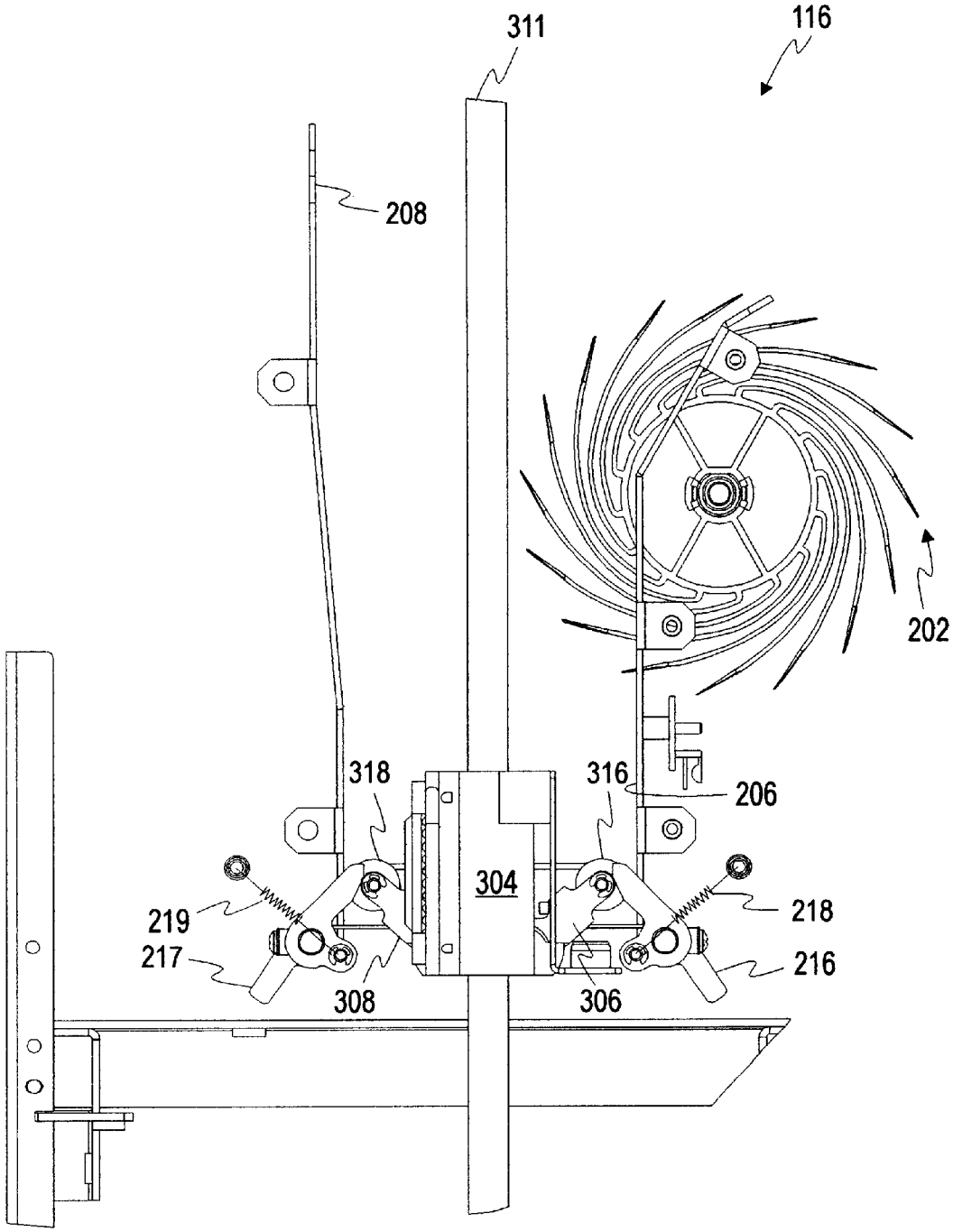
FIG. 13 is a rear view of a plunger assembly wherein the gate is in the closed position according to one embodiment of the document handling device of the present invention.

FIGS. 12 and 13 illustrate the interaction between the side arms 306, 308 and the levers 216, 217 when the paddle assembly 300 is descending towards and ascending away from the storage cassette 118, respectively. Initially, before descending towards the cassette, the shutters are in a first (closed) position. In the illustrated embodiment, it is the force imparted by the paddle 302 which opens the gate 210 when the paddle descends towards the storage cassette 118.

When the paddle is ascending away from the storage cassette 119, it is the rollers 316, 318 coupled to the side arms 306, 308 which engage the levers 216, 217 that close the gate 210. The levers 216, 217 shown in FIG. 12 are positioned in the open position. When descending towards the storage cassette 118, the rollers 316, 318 contact the levers 216, 217 and roll around the levers 216, 217 leaving the shutters in the open position. The side arms 306, 308 are hinged in a manner which allows the side arms 306, 308 to rotate inward towards the base 304 as the rollers 316, 318 engage the levers 216, 217. FIG. 13 illustrates the levers in the second position wherein the gate 210 is closed. When the paddle ascends out of the storage cassette, the side arms 306, 308 are biased away from the base 304. The rollers 316, 318 engage the levers 216, 217 causing the levers to rotate upward to the first position thus closing the gate.

Figure 14:
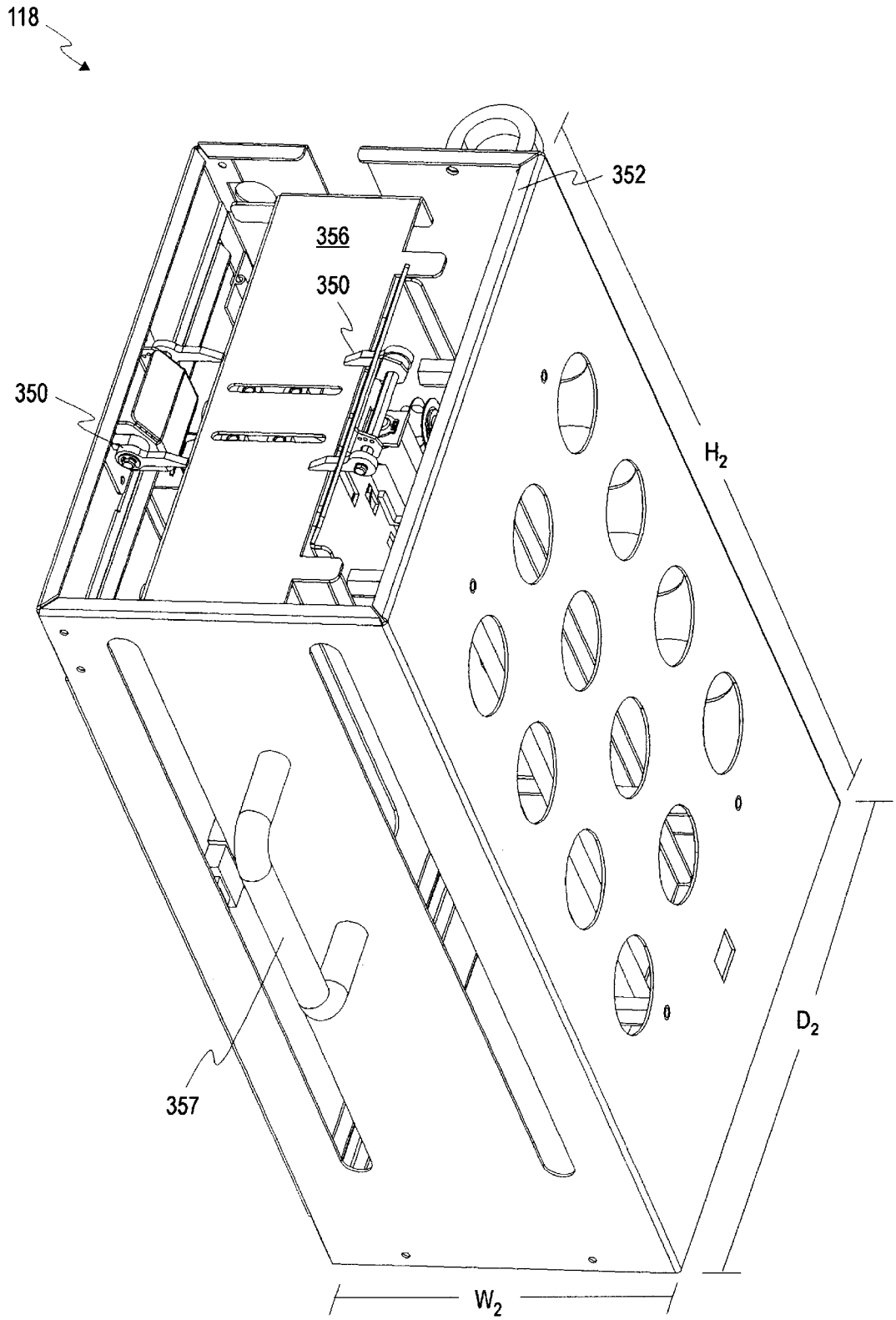
FIG. 14 is a perspective view of a storage cassette according to one embodiment of the document handling device of the present invention.
Figure 15:
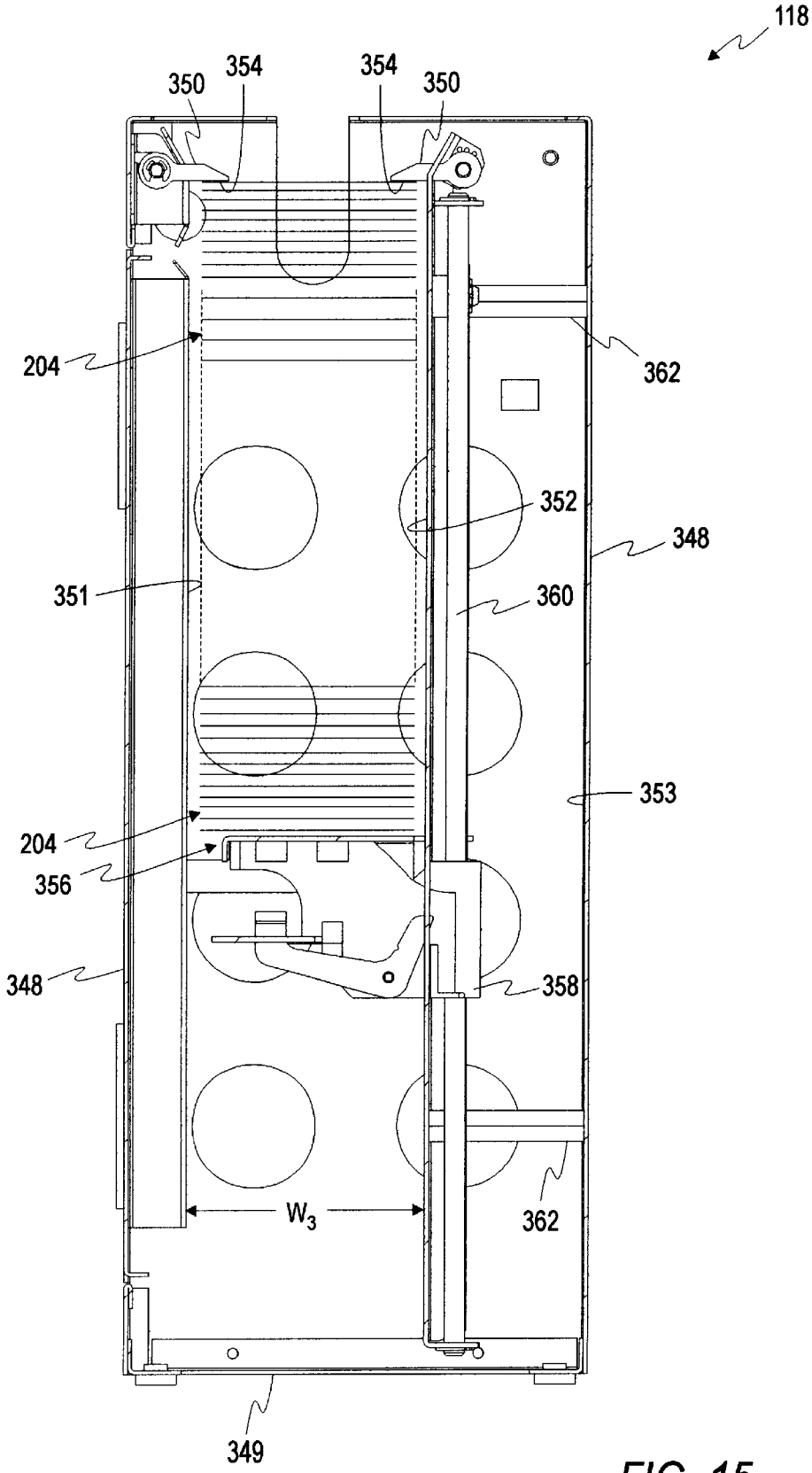
FIG. 15 is a rear view of a storage cassette according to one embodiment of the document handling device of the present invention.
Figure 16:
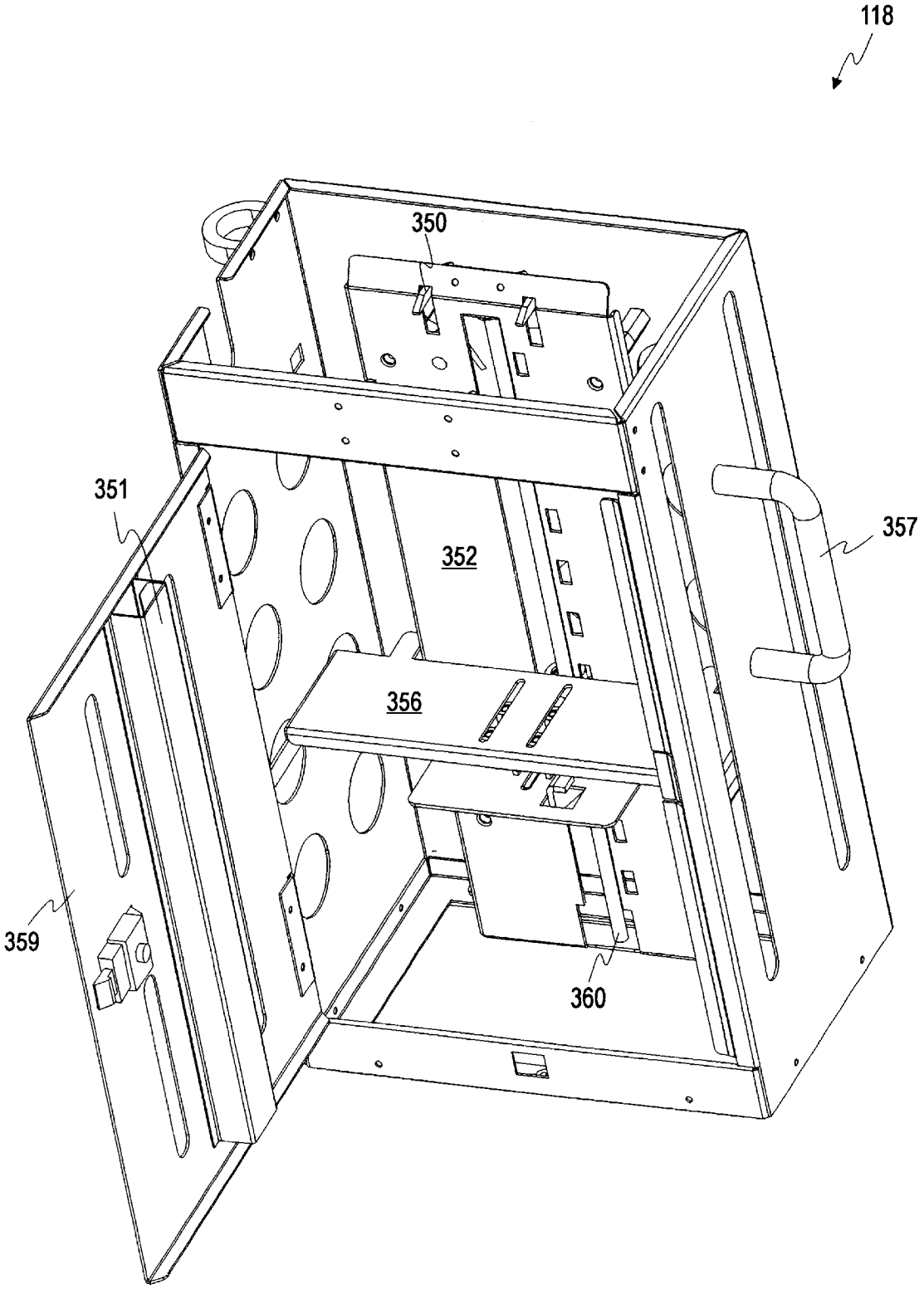
FIG. 16 is a perspective view of a storage cassette where the door is open according to one embodiment of the document handling device of the present invention.

FIGS. 14, 15, and 16 illustrate the components of the storage cassettes 118. The bills 204 are stored within the cassette housing 348 which has a base 349. Each storage cassette 118 contains two pairs of retaining tabs 350 positioned adjacent to the interior walls 351, 352 of the storage cassette. The lower surface 354 of each tab 350 is substantially planar. The tabs 350 are hingedly connected to the storage cassette 118 enabling the tabs 350 to downwardly rotate from a horizontal position, substantially perpendicular with the side interior walls 351, 352 of the cassette 118, to a vertical position, substantially parallel to the interior walls 351, 352 of the cassette 118. The tabs 350 are coupled to springs (not shown) to maintain the tabs in the horizontal position.

The storage cassette 118 contains a slidable platform 356 which is biased upward. During operation of the currency handling system 100, the platform 356 receives stacks of bills from the escrow compartment 116. The floor 356 is attached to a base 358 which is slidably mounted to a vertical support member 360. The base 358 is spring-loaded so that it is biased upward and in turn biases the platform 356 upward. The storage cassettes 118 are designed to be interchangeable so that once full, a storage cassette can be easily removed from the currency handling device 100 and replaced with an empty storage cassette 118. In the illustrated embodiment, the storage cassette 118 is equipped with a handle 357 in order to expedite removal and/or replacement of the storage cassettes 118. Also in the illustrated embodiment, the storage cassette 118 has a door 359 which enables an operator to remove bills from the storage cassette 118

Figure 17A:
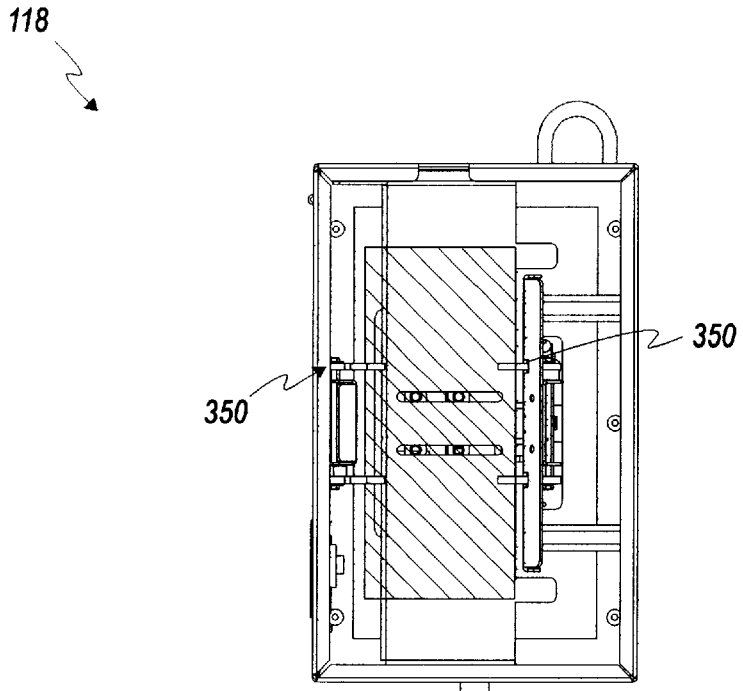
FIG. 17*a* is a top view of a storage cassette sized to accommodate United States currency documents according to one embodiment of the document handling device of the present invention.
Figure 17B:
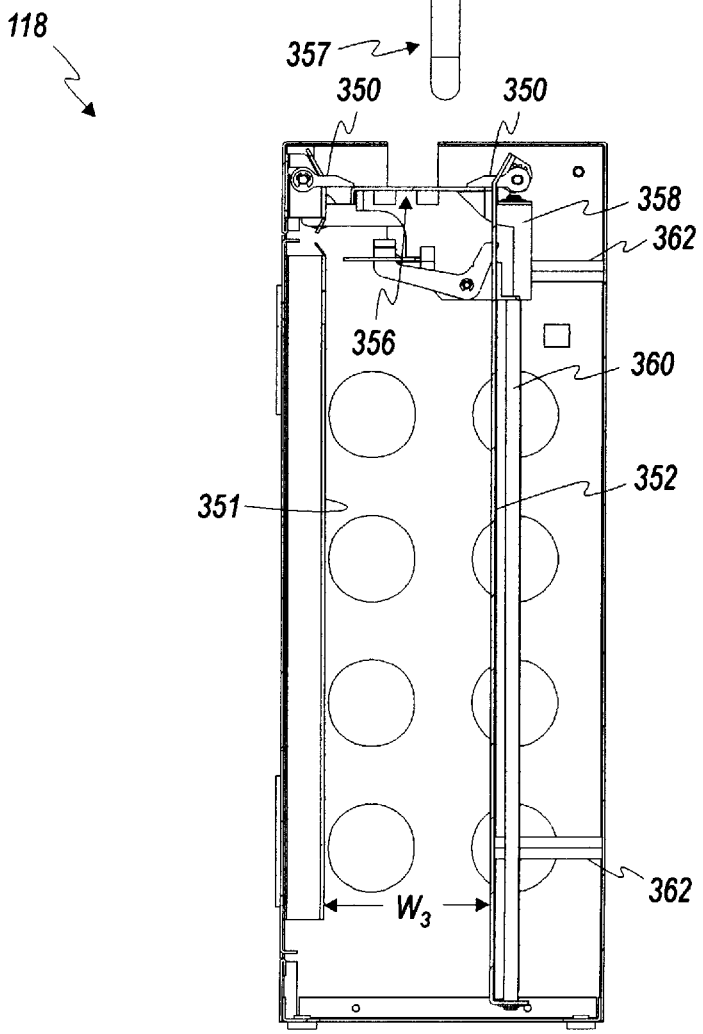
FIG. 17*b* is a rear view of a storage cassette sized to accommodate United States currency documents according to one embodiment of the document handling device of the present invention.
Figure 18A:
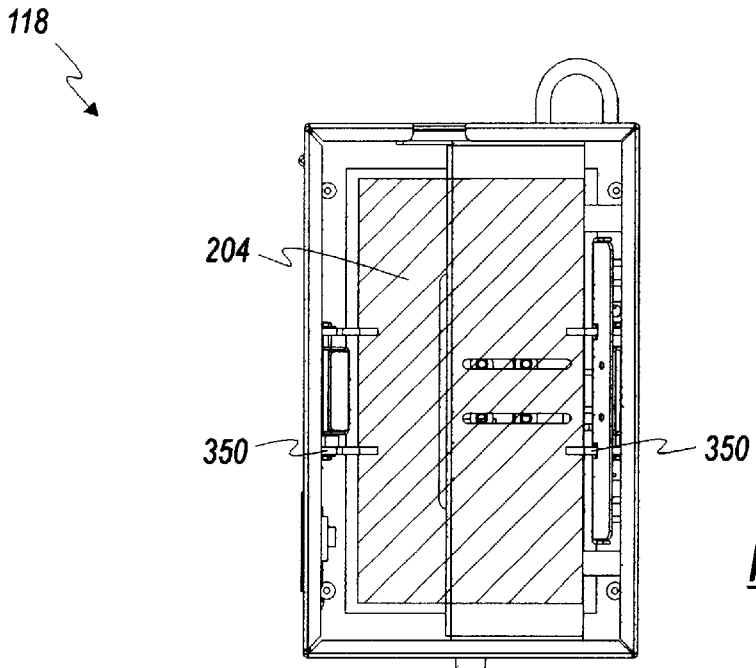
FIG. 18*a* is a top view of a storage cassette sized to accommodate large documents according to one embodiment of the document handling device of the present invention.
Figure 18B:
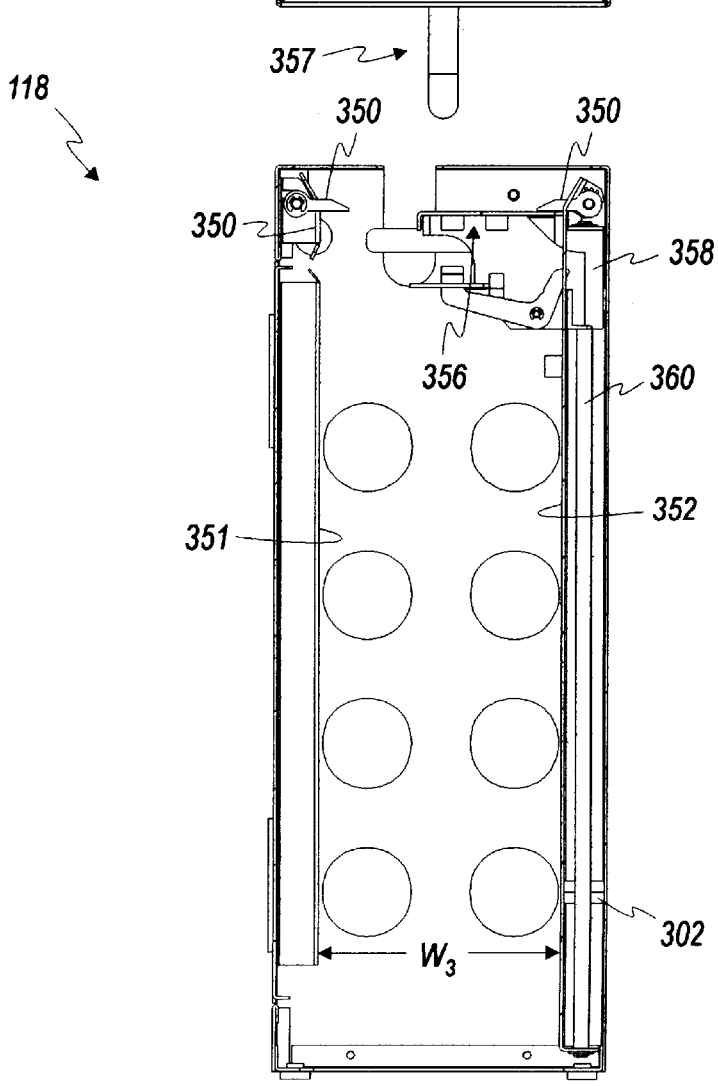
FIG. 18*b* is a rear view of a storage cassette sized to accommodate large documents according to one embodiment of the document handling device of the present invention.

The storage cassettes 118 are dimensioned to accommodate documents of varying sizes. In the illustrated embodiment, the storage cassettes 118 has a height, $H_2$, of approximately 15.38 inches (39 cm), a depth, $D_2$, of approximately 9 inches (22.9 cm), and a width, $W_2$, of approximately 5.66 inches (14.4 cm). The storage cassette illustrated in FIG. 15 has stand-offs 362 to set interior wall 352 off a fixed distance from in the interior wall 353 of the cassette housing 348. The interior walls 351, 352 aid in aligning the bills in a stack within the storage cassettes. The embodiment of the storage cassette illustrated in FIG. 15 is sized to accommodate United States currency documents. To properly accommodate United States currency documents, the interior width of the storage cassette, $W_3$, is approximately 2.88 inches. FIGS. 17*a* and 17*b* also illustrate an embodiment of the storage cassette 118 sized to accommodate U.S. currency documents which have a width of approximately 2.5 inches (approximately 6.5 cm) and a length of approximately 6 inches (approximately 15.5 cm). In alternative embodiments, the length of the stand-offs 362 can be varied to accommodate documents of varying sizes. For example, the embodiment disclosed in FIGS. 18*a* and 18*b* has an interior width, $W_3$ of approximately 4.12 inches (104.6 cm) and is sized to accommodate the largest international currency, the French 500 Franc note, which has width of approximately 3.82 inches (9.7 cm) and a length of approximately 7.17 inches (18.2 cm). In order to accommodate large documents and increase the interior width, $W_3$, of the storage cassette 118, the lengths of stand-offs 362, illustrated in FIG. 16*b*, are shortened.

Beginning with FIG. 7, the operation of one of the lower output receptacles 106*c*–106*h* will be described. Pursuant to a mode of operation, the bills 204 are directed by one of the diverters 130 into the escrow compartment 116 of the lower output receptacle. The stacker wheel 202 within escrow compartment 116 receives the bills 204 from the diverter 130. The stacker wheel 202 stacks the bills 204 on top of the gate 210. Pursuant to a preprogrammed mode of operation, once a predetermined number of bills 204 are stacked in the escrow compartment 116, the control unit 120 instructs the currency handling device 100 to suspend processing currency bills and the paddle 302 then descends from its home position above the escrow compartment 116 to transfer the bills 204 into the storage cassette 118. Once the bills 204 have been deposited in the storage cassette 118 the currency handling device resumes operation until an escrow compartment is full or all the bills within the input receptacle 102 have been processed.

Referring now to FIGS. 8 and 9 the plunger assembly 300 downwardly travels placing the paddle 302 onto of the stack of bills 204. Upon making contact with the bills 204 the paddle 302 continues to travel downward. As the paddle 302 continues its descent, the paddle 302 forces the gate 210 to snap open. The paddle 302 imparts a force to the bills 204 that is transferred to the to the shutters 211, 212 causing the shutters 211, 212 to rotate from the closed position to the open position. The rotation of the shutters 211, 212 is indicated by the arrows B and C, respectively. Once the paddle 302 imparts the amount of force necessary to rotate levers 216, 217, the extension springs 218, 219 quickly rotate the shutters 211, 212 downward, thus "snapping" the gate 210 open. The downward rotation of the shutters 211, 212 causes each of the corresponding parallel bars 214, 215 to pivot which in turn rotates the levers 216, 217. The extension springs 218, 219 maintain the shutters 211, 212 in the open position allowing the paddle 302 to descend into the storage cassette 118. The hingedly connected side arms 306, 308 retract as the rollers 316, 318 to roll around the levers 216, 217 while the plunger assembly 300 is traveling downward into the cassette 118.

Referring now to FIG. 15, once the gate 210 is opened, the bills 204 fall a short distance onto the platform 356 of the storage cassette 118 or onto a stack of bills 204 already deposited on the platform 356. The paddle 302 continues its downward motion towards the storage cassette 118 to ensure that the bills 204 are transferred to the cassette 118. Initially, some bills 204 may be spaced apart from the platform 356 or the other bills 204 within the storage cassette by retaining tabs 350. As the plunger assembly 300 continues to descend downward into the cassette, the paddle 302 continues to urge the stack of bills 204 downward causing the retaining tabs 350 to rotate downward. The bills 204 are pushed past retaining tabs 350 and onto the platform 356.

Once the plunger assembly 300 has descended into the cassette 118 a distance sufficient for the paddle 302 to clear the retaining tabs 350 allowing the retaining tabs 350 to rotate upward, the plunger assembly initiates its ascent out of the storage cassette 118. The platform 356 urges the bills 204 upward against the underside of the paddle 302. The paddle 302 is equipped with two pairs of slots 324, 326 (FIG. 9) to enable the paddle to clear the pairs of retaining tabs 350. When the paddle 302 ascends past the pairs of retaining tabs 350 the bills 204 are pressed against the lower surfaces 354 of the pairs of retaining tabs 350 by the platform 356.

Referring now to FIG. 13, when the plunger assembly 300 is traveling upward out of the cassette 118, the rollers 316, 318 on the side arms 306, 308 engage the respective levers 216, 217 and move the respective levers 216, 217 from the second (open) position to the first (closed) position to move the gate 210 from the open position to the closed position as the paddle 302 ascends into the escrow compartment 116 after depositing the bills 204 in the storage cassette 118. The paddle 302 is mounted on the base 304 above the rollers 316, 318 on the side arms 306, 308 so that the paddle 302 clears the gate 210 before the gate 210 is moved to the closed position.

In alternative embodiments of the currency handling device 100, the output receptacles 106 can be sized to accommodate documents of varying sizes such as various international currencies, stock certificates, postage stamps, store coupons, etc. Specifically, to accommodate documents of different widths, the width of the escrow compartment 116, the gate 210, and the storage cassette 118 would need to be increased or decreased as appropriate. The document evaluation device 100 is sized to accommodate storage cassettes 118 and gates 210 of different widths. The entire transport mechanism 104 of the currency handling device 100 is dimensioned to accommodate the largest currency bills internationally. Accordingly, the document handling device 100 can be used to process the currency or documents of varying sizes.

In various alternative embodiments, the currency handling device 100 is dimensioned to process a stack of different sized currencies at the same time. For example, one application may require the processing of United States dollars (2.5 inches×6 inches, 6.5 cm×15.5 cm) and French currency (as large as 7.17 inches×3.82 inches, 18.2 cm×9.7 cm). The application may simply require the segregation of the U.S. currency from the French currency wherein the currency handling device 100 delivers U.S. currency to the first lower output receptacle 106*c* and the French currency to the second output receptacle 106*d*. In another alternative embodiment, the currency handling device 100 processes a mixed stack of U.S. ten and twenty dollar bills and French one hundred and two hundred Franc notes wherein the currency documents are denominated, counted, and authenticated. In that alternative embodiment, the U.S. ten and twenty dollar bills are delivered to the first 106*c* and second 106*d* lower output receptacles, respectively, and the French one hundred and two hundred Franc notes are delivered to the third 106*e* and fourth 106*f* lower output receptacle, respectively. In other alternative embodiments, the currency handling device 100 denominates, counts, and authenticates six different types of currency wherein, for example, Canadian currency is delivered to the first lower output receptacle 106*c*, United States currency is delivered to the second output receptacle 106*d*, Japanese currency is delivered to the third lower output receptacle 106*e*, British currency is delivered to the fourth lower output receptacle 106*f*, French currency is delivered to the fifth lower output receptacle 106*g*, and German currency is delivered to the sixth lower output receptacle 106*h*. In another embodiment, no call bills or other denominations of currency, such as Mexican currency for example, may be directed to the second upper output receptacle 106*b*. In another embodiment, suspect bills are delivered to the first upper output receptacle 106*a*.

In other alternative embodiments of the currency handling device 100, the user can vary the type of documents delivered to the output receptacles 106. For example, in one alternative embodiment an operator can direct, via the control unit 120, that a stack of one, five, ten, twenty, fifty, and one-hundred United States dollar bills be denominated, counted, authenticated, and directed into lower output receptacles 106*c*–106*h*, respectively. In still another alternative embodiment, the currency handling device 100 is also instructed to deliver other bills, such as a United States two dollar bill or currency documents from other countries that have been mixed into the stack of bills, to the second upper output receptacle 106*b*. In still another alternative embodiment, the currency handling device 100 is also instructed to count the number and aggregate value of all the currency bills processed and the number and aggravate value of each individual denomination of currency bills processed. These values can be communicated to the user via the display/user-interface 122 of the currency handling device 100. In still another alternative embodiment, no call bills and bills that are stacked upon one another are directed to the second upper output receptacle 106*b*. In still another alternative embodiment, the operator can direct that all documents failing an authentication test be delivered to the first upper output receptacle 106*a*. In another alternative embodiment, the operator instructs the currency handling device 100 to deliver no call bills, suspect bills, stacked bills, etc. to one of the lower output receptacles 106*c*–106*h*. The currency handling device 100 which has eight output receptacles 106*a*–106*h* provides a great deal of flexibility to the user. And in other alternative embodiments of the currency handling device 100, numerous different combinations for processing documents are available.

According to one embodiment, the various operations of the currency handling device 100 are controlled by processors disposed on a number of printed circuit boards ("PCBs") such as ten PCBs located throughout the device 100. In one embodiment of the present invention, the processors are Motorola processors, model number 86HC16, manufactured by Motorola, Inc. of Schaumburg, Ill. Each of the processors are linked to a central controller via a general purpose communications controller disposed on each PCB. In one embodiment of the present invention the communications controller is an ARCNET communications controller, model COM20020, manufactured by Standard Microsystems Corporation of Hauppauge, N.Y. The communications controller enables the central controller to quickly and efficiently communicate with the various components linked to the PCBs.

According to one embodiment, two PCBs, a "motor board" and a "sensor board," are associated with each pair of lower output receptacles 106*c*–106*h*. The first two lower output receptacles 106*c,d*, the second two lower output receptacles 106*e,f*, and the last two lower output receptacles 106*g,h* are paired together. Each of the lower output receptacles 106 contain sensors which track the movement of the bills into the lower output receptacles 106*c*–106*h*, detect whether each storage cassette 118*a*–118*e* is positioned within the currency handling device 100, detect whether the doors 359 of the storage cassettes 118 are opened or closed, and whether the cassettes 118 are full. These aforementioned sensors associated with each pair of the lower output receptacles are tied into a sensor board which is linked to the central controller. The operation of the plunger assembly

300, the stacker wheels 202, the portion of transportation mechanism 104 disposed above the lower output receptacles 116*c*–116*h*, and the diverters 130 are controlled by processors disposed on the motor board associated with each pair of lower output receptacle's 106*c*–106*h*. Those sensors 130 which track the movement of bills along the transportation mechanism 104 that are disposed directly above the lower output receptacles 106*c*–106*h* are also tied into the respective motor boards.

One of the four remaining PCBs is associated with the operation of the one or two stacker wheels 127 associated with the upper output receptacles 106*a,b*, the stripping wheels 140, the primary drive motor of the evaluation region 108, a diverter which direct bills to the two upper output receptacles 106*a,b*, and the diverter which then directs bills between the two upper output receptacles 106*a,b*. The remaining three PCBs are associated with the operation of the transport mechanism 104 and a diverter which directs bills from the transport path to the bill facing mechanism 110. The plurality of sensors 130 disposed along the transport mechanism 104, used to track the movement of bills along the transport mechanism 104, also tied into these three remaining PCBs.

As discussed above, the currency handling system utilizes flow control to track the movement of each individual bill through the currency handling device 100 as well as to detect the occurrence of bill jams within the currency handling device 100. Utilizing flow control not only allows the device 100 to more quickly detect bill jams, but also enables the device 100 to implement a bill jam reconciliation procedure which results in a significant time savings over the prior art. During normal operation, a processor in conjunction with the plurality of sensors 119 disposed along the transport mechanism 104 tracks each of the currency bills transported through the currency handling device 100 from the evaluation region 108 to the escrow regions 116. Accordingly, the processor monitors the number of bills that have, for example, advanced from the input receptacle 102 through the evaluation unit 108, the number of bills stacked in each of the escrow regions 116*a–f*, and the number of bills moved into the storage cassettes 118*a–f*. The device 100 maintains separate counts of the number of bills delivered into each escrow region 116 and each of the storage cassettes 118. As bills are moved from an escrow region 116 to a corresponding storage cassette 118 the total number of bills being moved is added to the total number of bills in the storage cassette 118.

Upon the detection of a bill jam occurring in the transport mechanism 104, the processor has maintained an accurate count of the number of bills which have already been transported into each escrow region 116. The integrity of the bill count is maintained because the flow control routine rapidly determines the presence of a bill jam within the transport mechanism 104. Again, as discussed above, if a bill does not pass the next sensor 119 within a predetermined number of encoder counts, the operation of the transportation mechanism 104 is suspended and the user is alerted of the error. Because the transporting of bills is suspended almost immediately upon failure of a bill to pass a sensor 119 within a specific timeframe (e.g. number of encoder counts) thus preventing the pile-up of bills, the processor "knows" the specific location of each of the bills within the device 100 because the operation of the device is suspended before bills are allowed to pile up.

Because of the almost immediate suspension of the transporting of bills, the integrity of the counts of the bills in the escrow regions 116 and the storage cassettes 118 are maintained. Before the system is flushed, the bills within each of the escrow regions 116 are downwardly transported from the escrow regions 116 to the corresponding storage cassettes 118. If the bill jam occurs in one of the escrow regions 116, bills located in other escrow regions 116 where the bill jam has not occurred are transported to the respective storage cassettes 118.

In one embodiment of the currency evaluation device 10, the user is notified via the user interface 122 of the occurrence of a bill jam and the suspension of the transporting of bills. The user is prompted as to whether the bills in the escrow regions 116 should be moved to the storage cassettes 118. In other embodiments of the currency handling device, those bills already in the escrow regions are automatically moved to the storage cassettes upon detection of a bill jam. The user is directed, via the user interface 122, to the proximate location of the bill jam in the transport mechanism 104. If necessary, the user can electronically jog the transport mechanism 104, as described above, to facilitate the manual removal of the bill jam. After clearing the bill jam and causing those bill already transported into the escrow regions 116 to be moved into the corresponding storage cassettes 118, the user is prompted to flush the bills currently within the transport mechanism 104. Flushing the bills causes those bills still remaining in the transport mechanism 104 to be transported to one of the escrow 116. After the remaining bills are flushed from the transport mechanism 116, the operator can remove the flushed bills from the escrow region 116 for reprocessing.

Figure 19:
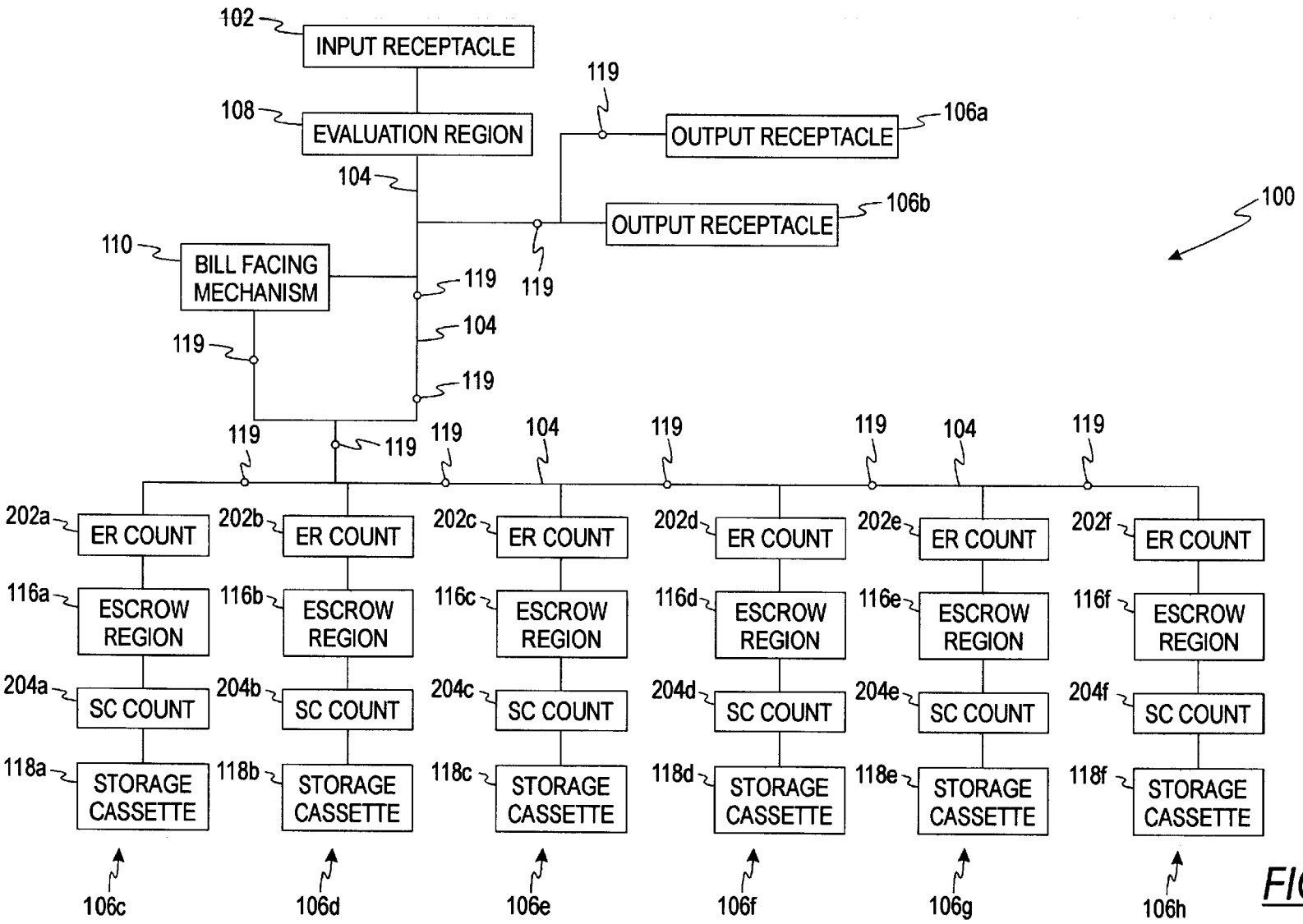
FIG. 19 is a functional block diagram according to one embodiment of the document handling device of the present invention.

Referring now to FIG. 19, the operation of the bill jam reconciliation process will be described in connection with the illustrated functional block diagram of the currency handling device 100. Pursuant to the user's selected mode of operation, currency bills are transported from the input receptacle 102 though the evaluation region 108 to one of the plurality of output receptacles 106*a–h*. According to some modes of operation, some of the currency bills all also transported through the bill facing mechanism 110 in those embodiments of the currency handling device 100 which implementing a bill facing mechanism 110. As each of the bills are transported thorough the currency handling device 100 by the transport mechanism 104, a processor, in connection with the plurality of bill passage sensors 119, tracks the movement of each of the bills from the evaluation region 106 to each of the escrow regions 116*a–f* pursuant to the flow control process discussed above. As bills are delivered into each of the escrow regions 116*a–f*, a escrow region bill counter 202 ("ER Count" in FIG. 19) assigned to each escrow region 116 maintains a count of the number of bills transported into each escrow region 116. After a predetermined number of bills have been transported into an escrow region 116, the operation of the transport mechanism is temporarily suspended while the bills are moved from the escrow region 116 to the corresponding storage cassette 118. A storage cassette counter 204 ("SC Count" in FIG. 19) corresponding to each storage cassette 118, maintains a count of the total number of bills moved into a storage cassette. Upon moving bills from the escrow region 116 to the corresponding storage cassette 118, the escrow region count is added to the storage cassette count. After the adding the escrow region count and the storage cassette count, the escrow region counter 202 is reset to zero and the operation of the transport mechanism is resumed.

Upon detection of the occurrence of a bill jam, the operation of the transport mechanism 104 is suspended. At the time of the occurrence of a bill jam, each of the escrow regions have as many as two hundred fifty bills or as little as zero bills transported therein. A count of the specific number of bills in each of the escrow regions 1116*a–f* is maintained by each of the escrow region counters 202*a–f*. In response to user input, the bills within the escrow regions 116 are moved from the escrow regions 116 to the storage cassettes 118 and the escrow bill count 202 is added to the storage cassette bill count 204. The operator of the currency handling device 100 can then clear the bill jam and flush the remaining bill from the transport mechanism 104 as discussed above. If the bill jam has occurred in one of the escrow regions 116, the bills in the remaining escrow regions 116 not having bill jams detected therein are moved to the corresponding storage cassettes 118. Those bill already transported into the escrow region 116 having the bill jam detected therein are reprocessed along with the bills flushed from the transport mechanism 104.

The ability of the currency handling device 100 to transport those bills already processed into the escrow regions 116 and into the storage cassettes 118 while maintaining the integrity of the bill counts 202,204 with respect to each output receptacle 106*c–h* is a significant improvement resulting in appreciable time savings over prior art devices. In prior art devices, upon the occurrence of a bill jam, the operator would have to clear the bill jam and manually turn a hand crank to move the remaining bills from the transport path into the escrowing regions. Prior art devices do not maintain separate running totals as bills pass various points within the device. For example, a prior device may only count the bills as they are transported through an evaluation region of the currency handing machine. Bills exiting the evaluation region are included in the totals regardless of whether they are involved in bill jams or are successfully transported to an output receptacle. Therefore, when a bill jam occurs, those bills involved in the bill jam as well as those bills already transported to the output receptacles have to be reprocessed. Other prior art devices having both holding areas and storage areas only maintain a count of the number of bill in the storage areas, but not a count of the number of bills in the holding areas.

Reprocessing all of the bills already transported into the holding areas is a time consuming process as the number of bills to be re-processed can be voluminous. In the present device for example, each of the escrow regions 116 can accommodate approximately 250 bills. Six escrow regions presents the possibility of having to reprocess up to 1500 bills upon the occurrence of a bill jam. The problem is further exasperated when modular lower output receptacles 106 are added. For example, the addition of eight modular lower output receptacles 106 brings the total number of lower output receptacles 106 to fourteen, thus up to 3500 bills would have to be reprocessed. The inefficiencies associated with this procedure arise from the loss of productivity while the device 100 is stopped and the time required to remove the stacks of bills from the escrow regions 116 as well as the time required to re-process the bills pulled from the escrow regions 116.

While the invention is susceptible to various modifications and alternative forms, specific embodiments thereof have been shown by way of example in the drawings and herein described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

What is claimed is:

1. A currency handling device for rapidly processing a plurality of currency bills, the device comprising:

an input receptacle adapted to receive stacks of bills to be processed;

a plurality of output receptacles adapted to receive the bills after the bills have been evaluated, at least one of the output receptacles including a holding area and a storage area;

a transport mechanism adapted to transport the bills, one at a time, along a transport path from the input receptacle into the holding areas;

an evaluating unit adapted to determine information concerning the bills, the evaluation unit including at least one evaluating sensor positioned along the transport path between the input receptacle and the plurality of output receptacles;

a plurality of bill passage sensors sequentially disposed along the transport path, each of the plurality of sensors being adapted to detect the passage of a bill as each bill is transported past each sensor; and a controller being adapted to track the movement of bills along the transport path, the controller adapted to separately maintain a count of the number of bills transported to the holding area and the storage area, the controller being adapted to detect the presence of a bill jam and suspend operation of the transport mechanism when a bill is not transported past one of the plurality of bill passage sensors within a predetermined amount of time.

2. The currency handling device of claim 1 wherein the controller is adapted to cause the bills in the holding area to be moved to the corresponding storage area after detection of a bill jam.

3. The currency handling device of claim 2 further comprising a user interface adapted to receive input from a user of the currency handling device, the controller adapted to prompt the user for input before causing the bills in the holding area to be moved to the corresponding storage area after a bill jam is detected, the controller adapted move the bills in the holding area to the corresponding storage area in response to user input.

4. The currency handling device of claim 2 wherein the controller is adapted to update the count of the number of bills transported into a storage area by adding thereto the count of the number of bills transported into the corresponding holding area prior to causing the bills in the holding area to be moved to the corresponding storage area.

5. The currency handling device of claim 4 wherein the controller is adapted to reset the count of the number of bills transported into the holding area after causing the bills in each of the holding areas to be moved to the corresponding storage area.

6. The currency handling device of claim 2 wherein the controller is adapted to cause the transport mechanism to flush the bills from the transport path after the bills in the holding area are moved to the corresponding storage area.

7. The currency handling device of claim 6 further comprising a user interface adapted to receive input from a user of the currency handling device, wherein the controller is adapted to prompt the user as whether to flush the bills, the controller being adapted to cause the transport mechanism to flush the bills in response to user input.

8. The currency handling device of claim 2 wherein a plurality of the output receptacles include a holding area and a storage area and the controller is adapted to detect the presence of a bill jam in each of the holding areas, the controller being adapted to suspend operation of the transport mechanism upon the detection of a bill jam in one of the holding areas, the controller being adapted to cause the bills in each of the holding areas not having a bill jam detected therein to be moved to the corresponding storage areas upon detection of a bill jam.

9. The currency handling device of claim 8 further comprising a user interface adapted to receive input from a user of the currency handling device, the controller adapted to prompt the user for input before causing the bills in each of the holding areas not having a bill jam detected therein to be moved to the corresponding storage areas, the controller adapted move the bills in each of the holding areas not having bill jams detected therein to the corresponding storage areas in response to user input.

10. The currency handling device of claim 9 wherein the controller is adapted to prompt the user as whether to flush the bills, the controller being adapted cause the transportation mechanism to flush the bills in response to user input.

11. The currency handling device of claim 9 wherein the controller is adapted to electronically jog the transport mechanism to facilitate the clearing of the bill jam in response to user input via the user interface.

12. The currency handling device of claim 1 wherein the device is adapted to process bills at a rate of at least about 800 bills per minute.

13. The currency handling device of claim 1 wherein the device is adapted to process bills at a rate of at least about 1500 bills per minute.

14. The currency handling device of claim 1 wherein each of the output receptacles including a holding area and a storage area further include a paddle adapted to move the bills from the holding area to the corresponding storage areas.

15. The currency handling device of claim 1 further comprising:

a bill facing mechanism disposed along the transport path between the evaluation region and the plurality of output receptacles, the bill facing mechanism being adapted to rotate a bill approximately 180°;

a plurality of bill passage sensors sequentially disposed along the bill facing mechanism; and wherein the controller is adapted to detect a bill jam within the bill facing mechanism.

16. The currency handling device of claim 1 further comprising an encoder adapted to generate an encoder count for each incremental movement of the transport mechanism.

17. A currency handling device for rapidly processing a plurality of currency bills, the device comprising:

an input receptacle adapted to receive stacks of bills to be processed;

a plurality of output receptacles adapted to receive the bills after the bills have been evaluated, at least two of the output receptacles including a holding area and a storage area;

a transport mechanism adapted to transport the bills, one at a time, along a transport path from the input receptacle into the holding areas, an evaluating unit adapted to determine information concerning the bills, the evaluation unit including at least one evaluating sensor positioned along the transport path between the input receptacle and the plurality of output receptacles;

a plurality of bill passage sensors sequentially disposed along the transport path, each of the plurality of sensors being adapted to detect the passage of a bill as each bill is transported past each sensor, an encoder adapted to produce an encoder count for each incremental movement of the transport mechanism; and a controller being adapted to track the movement of bills along the transport path, the controller adapted to separately maintain a count of the number of bills transported to each of the holding areas and each of the storage areas, the controller being adapted to detect the presence of a bill jam and suspend operation of the transport mechanism when a bill is not transported past one of the plurality of bill passage sensors within a requisite number of encoder counts.

18. The currency handling device of claim 17 wherein the controller is adapted to cause the bills in each of the holding areas to be moved to the corresponding storage area after detection of a bill jam.

19. The currency handling device of claim 18 further comprising a user interface adapted to receive input from a user of the currency handling device, the controller adapted to prompt the user for input before causing the bills in each of the holding areas to be moved to the corresponding storage areas after a bill jam is detected, the controller adapted move the bills in the holding areas to the corresponding storage areas in response to user input.

20. The currency handling device of claim 18 wherein the controller is adapted to update the count of the number of bills transported into a storage area by adding thereto the count of the number of bills transported into the corresponding holding area prior to causing the bills in the holding area to be moved to the corresponding storage area.

21. The currency handling device of claim 20 wherein the controller is adapted to reset the count of the number of bills transported into the holding area after causing the bills in each of the holding areas to be moved to the corresponding storage area.

22. The currency handling device of claim 18 wherein the controller is adapted to cause the transport mechanism to flush the bills from the transport path after causing the bills in each of the holding areas to be moved to the corresponding storage area after detection of a bill jam.

23. The currency handling device of claim 22 further comprising a user interface adapted to receive input from a user of the currency handling device, the controller being adapted to prompt the user as whether to flush the bills, the controller being adapted to cause the transport mechanism to flush the bills in response to user input.

24. The currency handling device of claim 17 wherein the controller is adapted to detect the presence of a bill jam in the holding areas, the controller adapted to suspend operation of the transport mechanism upon the detection of a bill jam in one of the holding areas, the controller being adapted to cause the bills in each of the holding areas not having a bill jam detected therein to be moved to the corresponding storage areas upon detection of a bill jam.

25. The currency handling device of claim 24 further comprising a user interface adapted to receive input from a user of the currency handling device, the controller adapted to prompt the user for input before causing the bills in each of the holding areas not having a bill jam detected therein to be moved to the corresponding storage areas, the controller adapted move the bills in each of the holding areas not having bill jams detected therein to the corresponding storage areas in response to user input.

26. The currency handling device of claim 24 further comprising a user interface adapted to receive input from a user of the currency handling device, the controller being adapted to prompt the user as whether to flush the bills, the controller being adapted to cause the transport mechanism to flush the bills from the transport path in response to user input.

27. The currency handling device of claim 17 wherein the controller is adapted to electronically jog the transport mechanism to facilitate clearing of the bill jam in response to user input via a user interface.

28. The currency handling device of claim 17 wherein the device is adapted to process bills at a rate of at least about 800 bills per minute.

29. The currency handling device of claim 17 wherein the device is adapted to process bills at a rate of at least about 1500 bills per minute.

30. The currency handling device of claim 17 further comprising:

a bill facing mechanism disposed along the transport path between the evaluation region and the plurality of output receptacles, the bill facing mechanism being adapted to rotate a bill approximately 180°;

a plurality of bill passage sensors sequentially disposed along the bill facing mechanism, and wherein the controller is adapted to detect a bill jam within the bill facing mechanism.

31. The currency handling device of claim 17 wherein each of the output receptacles including a holding area and a storage area further include a paddle adapted to move the bills from the holding area to the corresponding storage area.

* * * * *